United States Patent [19]

Nakamura et al.

[11] Patent Number: 4,695,530

[45] Date of Patent: Sep. 22, 1987

[54] METHOD FOR FORMING IMAGE USING SILVER HALIDE COLOR PHOTOGRAPHIC LIGHT-SENSITIVE MATERIAL

[75] Inventors: Kotaro Nakamura; Takatoshi Ishikawa, both of Kanagawa, Japan

[73] Assignee: Fuji Photo Film Co., Ltd., Kanagawa, Japan

[21] Appl. No.: 854,976

[22] Filed: Apr. 23, 1986

[30] Foreign Application Priority Data

Apr. 23, 1985 [JP] Japan ..... 60-87133

[51] Int. Cl.[4] ..... G03C 5/38; G03C 5/44; G03C 7/36; G03C 7/42

[52] U.S. Cl. ..... 430/381; 430/386; 430/387; 430/393; 430/418; 430/430; 430/455; 430/460; 430/461

[58] Field of Search ..... 430/393, 386, 387, 418, 430/430, 455, 460, 461, 381

[56] References Cited

U.S. PATENT DOCUMENTS

| | | | |
|---|---|---|---|
| 4,311,781 | 1/1982 | Mifune et al. | 430/264 |
| 4,366,233 | 12/1982 | Nakamura | 430/393 |
| 4,414,305 | 11/1983 | Nakamura et al. | 430/373 |
| 4,542,094 | 9/1985 | Koshizuka et al. | 430/569 |
| 4,588,679 | 5/1986 | Furutachi | 430/551 |

FOREIGN PATENT DOCUMENTS

| | | |
|---|---|---|
| 54-99432 | 6/1978 | Japan . |
| 55-65953 | 11/1978 | Japan . |
| 61-65243 | 11/1984 | Japan . |

*Primary Examiner*—Richard L. Schilling
*Assistant Examiner*—Lee C. Wright
*Attorney, Agent, or Firm*—Sughrue, Mion, Zinn, Macpeak & Seas

[57] ABSTRACT

A method for forming an image in a silver halide color photographic light-sensitive material comprising developing an imagewise exposed silver halide color photographic light-sensitive material and then bleach fixing the silver halide color photographic light-sensitive material in a bleach fixing bath, the silver halide photographic color light sensitive material comprising a support having thereon a silver halide emulsion layer containing a yellow coupler, a silver halide emulsion layer containing a magenta coupler and a silver halide emulsion layer containing a cyan layer, wherein the silver halide emulsion layer containing the magneta coupler contains at least one kind of pyrazoloazole type coupler represented by the general formula (I):

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za-Zb bond and the Zb-Zc bond being a double bond and the other being a single bond; an aromatic ring may be condensed to the Zb-Zc bond; $R^1$ or X may form a polymer including a dimer or more; and when Za, Zb or Zc is a substituted methine group, the substituted methine group may form a polymer including a dimer or more; a photographic layer of the silver halide color photographic light-sensitive material or a processing solution contains at least $5.8\times10^{-4}$ mol per mol of silver halide contained in the silver halide color photographic light-sensitive material of at least one compound represented by the formulae (I) or (II):

(II)

(III)

wherein $R^2$, $R^3$, $R^4$ and $R^5$, which may be the same or different, each represents a hydrogen atom, a hydroxy group, an aliphatic residue, an alkyl group substituted with an aromatic group, an alkyl group substituted with an alkoxy group, an alkyl group substituted with a hydroxy group, a carboxy group or an alkoxy carbonyl group or an aromatic residue; or $R^2$ and $R^3$ may be bonded each other to form a 5-membered or 6-membered saturated or unsaturated ring; and a developing agent which is introduced into the bleach-fixing bath is at least $1.0\times10^{-4}$ mol per mol of a bleaching agent thereof.

30 Claims, No Drawings

METHOD FOR FORMING IMAGE USING SILVER HALIDE COLOR PHOTOGRAPHIC LIGHT-SENSITIVE MATERIAL

FIELD OF THE INVENTION

The present invention relates to a method for processing a silver halide color photographic light-sensitive material. More particularly, it relates to a method for processing a silver halide color photographic light-sensitive material wherein substantially no silver remains in the photographic material after processing, even when the photographic light-sensitive material is processed with an exhausted processing solution (running solution) and which provides images having remarkably good color reproducibility and image preservability.

BACKGROUND OF THE INVENTION

In order to form images, a silver halide color photographic light-sensitive material is conventionally subjected to a series of processing steps after imagewise exposed to light. More specifically, during a color development step, a color developing agent reduces the exposed silver halide to produce developed silver and the color developing agent per se is oxidized to yield an active oxidized product which reacts with a coupler whereupon a dye is formed. After that, in a silver removing step, developed silver is oxidized with an oxidizing agent (usually called a bleaching agent) and removed upon fixing together with silver halide which has not participated in the color development reaction and remains as is in the photographic material. By these steps a color image is obtained.

In the silver removing step, a bleaching bath or a bleach-fixing bath is employed. One problem that arises when using the latter, is that an inorganic bleaching agent is coexistent with a silver halide solubilizing agent in the same processing solution and the oxidizing power of the inorganic bleaching agent is too strong. Therefore, an organic chelate compound having a weak oxidizing power such as a metallic iron salt of aminopolycarboxylic acid is usually employed as a bleaching agent.

Such a bleach-fixing solution, which originally has only a weak oxidizing power, causes some problems when a short processing time, as used in recent years, is used, since the bleach-fixing bath, upon repeated use, contains developing agent taken from an exhausted developing solution. That is, it causes (1) so-called insufficient color formation in which a satisfactory density is not obtained because some of the cyan dye remains in its leuco form and (2) so-called insufficient silver removal in which silver remains in the photographic material because the silver removing speed for dissolving silver out of the photographic material is reduced.

As a result of investigations by the present inventors, it has been found that slow silver removal also causes delayed conversion of the leuco form of a dye to a cyan dye. Therefore, insufficient silver removal is a major problem that must be considered in designing color photographic light-sensitive materials.

As a silver halide photographic material for obtaining a color print, a color photographic light-sensitive material comprising at least three layers including a red-sensitive emulsion layer containing a cyan coupler, a green-sensitive emulsion layer containing a magenta coupler and a blue-sensitive emulsion layer containing a yellow coupler, provided relative to the incident light of exposure in the above order, is conventionally employed. However, when using a green-sensitive emulsion layer containing a pyrazoloazole type magenta coupler, the silver removing speed is slow in comparison to when a 5-pyrazolone type magenta coupler, which has been heretofore employed is used, probably, because the pyrazoloazole type coupler is apt to adsorb to silver halide particles due to its structural character. As a result, there is a disadvantage in that the silver removing speed of the blue-sensitive emulsion layer which is ordinarily positioned below the green-sensitive emulsion layer is also retarded.

Such a reduction in silver removing speed exerts, practically, a particularly bad influence when a bleach-fixing solution in which only a bleaching agent having a weak bleaching power is employed; particularly, where a bleach-fixing solution containing a small amount of a developing agent (at least $1\times10^{-4}$ mol of the developing agent per mol of the bleaching agent) carried from the developing bath is used.

On the other hand, a pyrazoloazole type magenta coupler has many advantageous properties. Specifically, a color image obtained therefrom is superior with respect to color reproduction since undesirable absorption in the blue light and red light regions are small in comparison to the undesirable absorption that occurs when a conventional 5-pyrazolone type magenta coupler is used. Further, when a photographic material containing a pyrazoloazole type magenta coupler is exposed to light during storage and/or is stored under high humidity condition, the occurrence of yellow stain in the image formed upon development is small, probably because the coupler per se is stable to light, heat and humidity and hard to decompose.

SUMMARY OF THE INVENTION

Therefore, a general object of the present invention is to provide a method for forming an image using a silver halide color photographic light-sensitive material in which the excellent properties of pyrazoloazole type magenta coupler are utilized and the insufficient silver removal which is a disadvantage of such couplers is eliminated.

Specifically, an object of the present invention is to provide a method for forming an image using a color photographic light-sensitive material which has excellent color reproducibility; especially a magenta color image having a good light absorption characteristics.

Another object of the present invention is to provide a method for forming an image using a color photographic light-sensitive material which provides an image having good fastness and reduced stain in white background areas upon storage under dark or light conditions.

A further object of the present invention is to provide a method for forming an image using a color photographic light-sensitive material wherein substantially no silver remains in the photographic material after processing, even when the photographic light-sensitive material is processed with an exhausted developing solution (running solution).

Other objects of the present invention will become apparent from the following detailed description and examples.

These objects are obtained by a method of forming an image in a silver halide color photographic light-sensitive material, comprising developing an imagewise exposed silver halide color photographic light-sensitive material and then bleach fixing the silver halide color photographic light-sensitive material in a bleach fixing bath, the silver halide photographic color light-sensitive material comprising a support having thereon a silver halide emulsion layer containing a yellow coupler, a silver halide emulsion layer containing a magenta coupler and a silver halide emulsion layer containing a cyan coupler, wherein the silver halide emulsion layer containing a magenta coupler contains at least one pyrazoloazole type coupler represented by the general formula (I):

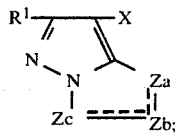

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za-Zb bond and the Zb-Zc bond being a double bond and the other being a single bond; an aromatic ring may be condensed to the Zb-Zc bond; $R^1$ or X may form a polymer including a dimer or more; and when Za, Zb or Zc is a substituted methine group, the substituted methine group may form a polymer including a dimer or more; a photographic layer of the silver halide photographic light-sensitive material or a processing solution contains at least $5.0\times10^{-4}$ mol per mol of silver halide contained in the silver halide photographic light-sensitive material of at least one compound represented by the formulae (II) or (III):

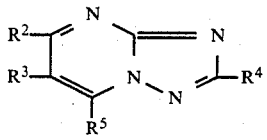

(II)

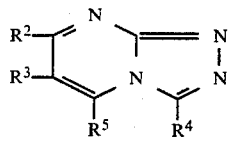

(III)

wherein $R^2$, $R^3$, $R^4$ and $R^5$, which may be the same or different, each represents a hydrogen atom, a hydroxy group, an aliphatic residue, an alkyl group substituted with an aromatic group, an alkyl group substituted with an alkoxy group, an alkyl group substituted with a hydroxy group, a carboxy group or an alkoxycarbonyl group, or an aromatic residue; or $R^2$ and $R^3$ may be bonded each other to form a 5-membered or 6-membered saturated or unsaturated ring; and a developing agent which is introduced into the bleach-fixing bath is at least $1.0\times10^{-4}$ mol per mol of a bleaching agent thereof.

DETAILED DESCRIPTION OF THE INVENTION

The compounds which can be employed in the present invention are described in detail below. Preferably $R^1$ has the same meaning as $R^{11}$ described hereinbelow.

The term "polymer" used in the general formula (I) means a compound containing at least two groups represented by the general formula (I) in its molecule, and includes a bis coupler and a polymer coupler. Preferably, the polymer coupler has a molecular weight of from about 10,000 to about 200,000. The polymer coupler may be either a homopolymer composed of only a monomer having a moiety represented by the general formula (I) (preferably a monomer having a vinyl group, hereinafter referred to as a vinyl monomer) or a copolymer composed of a vinyl monomer described above and a non-color forming ethylenic monomer which does not undergo coupling with the oxydation product of an aromatic primary amine developing agent.

Of the pyrazoloazole type magenta couplers represented by the general formula (I), preferred couplers are those represented by the following general formula (IV), (V), (VI), (VII), (VIII), (IX) or (X):

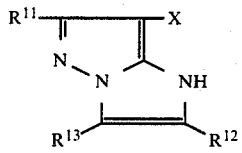

(IV)

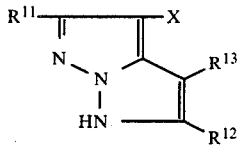

(V)

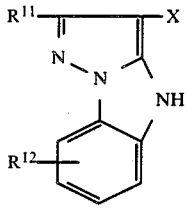

(VI)

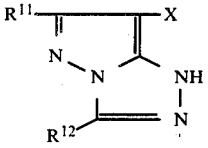

(VII)

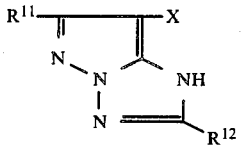

(VIII)

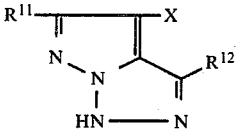

(IX)

-continued

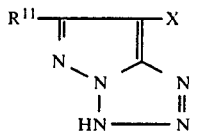

(X)

In the general formula (IV), (V), (VI), (VII), (VIII), (IX) or (X), $R^{11}$, $R^{12}$ and $R^{13}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group (these groups may be further substituted); and X represents a hydrogen atom, a halogen atom, a carboxy group or a group capable of being released upon coupling which is bonded to the carbon atom at the coupling position through an oxygen atom, a nitrogen atom or a sulfur atom. Also, $R^{11}$, $R^{12}$, $R^{13}$ or X may be a divalent group to form a bis coupler. Further, the coupler represented by the general formula (IV), (V), (VI), (VII), (VIII), (IX) or (X) may be in the form of a polymer coupler in which the coupler moiety exists at the main chain or the side chain of the polymer and particularly a polymer coupler derived from a vinyl monomer having the coupler moiety represented by the general formulae (IV) to (X) described above is preferred. In this case, $R^{11}$, $R^{12}$, $R^{13}$ or X represents a vinyl group or a linking group. The number of total carbon atoms of $R^{11}$, $R^{12}$ and $R^{13}$ altogether is preferably about 10 to about 100 per pyrazoloazole ring.

In more detail, $R^{11}$, $R^{12}$ and $R^{13}$ each represents a hydrogen atom, a halogen atom (e.g., a chlorine atom, a bromine atom, etc.), an alkyl group (e.g., a methyl group, a propyl group, a tert-butyl group, a trifluoromethyl group, a tridecyl group, a 3-(2,4-di-tert-amylphenoxy)propyl group, an allyl group, a 2-dodecyloxyethyl group, a 3-phenoxypropyl group, a 2-hexylsulfonylethyl group, a cyclopentyl group, etc.), an aryl group (e.g., a phenyl group, a 4-tert-butylphenyl group, a 2,4-di-tert-amylphenyl group, a 4-tetradecanamidophenyl group, etc.), an aralkyl group (e.g., a benzyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-tert-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-tert-amylphenoxy)-butylamido group, a γ-(3-tert-butyl-4-hydroxyphenoxy)butylamido group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-tert-butyl-4-hydroxyphenoxy)dodecanamido]anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), an alkylthio group (e.g., a methylthio group, an octylthio group, a tetradecylthio group, a 2-phenoxyethylthio group, a 3-phenoxypropylthio group, a 3-(4-tert-butylphenoxy)propylthio group, etc.), an arylthio group (e.g., a phenylthio group, a 2-butoxy-5-tert-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methoxyloxy-5-tert-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g,, an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), an sulfinyl group (e.g., an octanesulfinyl group, a dodecylsulfinyl group, a phenylsulfinyl group, etc.) an alkoxycarbonyl group (e.g., a methoxycarbonyl group, a butyloxycarbonyl group, a dodecylcarbonyl group, an octadecylcarbonyl group, etc.) or an aryloxycarbonyl group (e.g., a phenoxycarbonyl group, a 3-pentadecyloxycarbonyl group, etc.); and X represents a hydrogen atom; a halogen atom (e.g., a chlorine atom, a bromine atom, an iodine atom, etc.); a carboxy group; a group bonded to the coupling position through an oxygen atom (e.g., an acetoxy group, a propanoyloxy group, a benzoyloxy group, a 2,4-dichlorobenzoyloxy group, an ethoxyoxaloyloxy group, a pyruvynyloxy group, a cinnamoyloxy group, a phenoxy group, a 4-cyanophenoxyl group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.); a group bonded to the coupling position through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-5-ethoxy-3-hydantoinyl group, a 2N-1,1-dioxo-3(2H)-oxo-1,2-benzisothiazolyl group, a 2-oxo-1,2-dihydro-1-pyridinyl group, an imidazolyl group, a pyrazoloyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, an arylazo group (e.g., a 4-methoxyphenylazo group, a 4-pivaloylaminophenylazo group, a 2-naphthylazo group, a 3-methyl-4-hydroxyphenylazo group, etc.)); or a group bonded to the coupling position through a sulfur atom (e.g., a phenylthio group, a 2-carboxyphenylthio group, a 2-methoxy-5-tert-octylphenylthio group, 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

In the coupler represented by the general formula (IV) or (V), $R^{12}$ and $R^{13}$ may combine with each other to form a 5-membered, 6-membered or 7-membered ring.

When $R^{11}$, $R^{12}$, $R^{13}$ or X represents a divalent group to form a bis coupler, $R^{11}$, $R^{12}$ or $R^{13}$ preferably represents an unsubstituted alkylene group having 1 to 16 carbon atoms or a substituted alkylene group having about 10 to about 100 carbon atoms in total per pyrazoloazole ring (e.g., a methylene group, an ethylene group, a 1,10-decylene group, $—CH_2CH_2—O—CH_2CH_2—$, etc.), an unsubstituted phenylene group or a substituted phenylene group having about 6 to about 100 carbon atoms in total per pyrazoloazole ring (e.g., a 1,3-phenylene group, a 1,3-phenylene group,

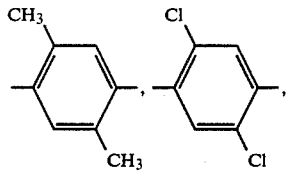

(etc.), an $—NHCO—R^{14}—CONH—$ group (wherein $R^{14}$ represents an unsubstituted alkylene group having 1 to 16 carbon atoms or a substituted alkylene group having about 10 to about 100 carbon atoms in total per pyrazoloazole ring, or an unsubstituted phenylene group or a substituted phenylene group having about 6 to about 100 carbon atoms in total per pyrazoloazole ring, e.g., $—NHCOCH_2CH_2CONH—$,

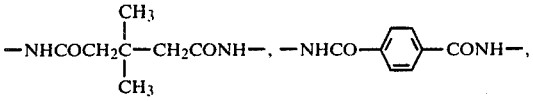

etc.) or an $—S—R^{14}—$ group (wherein $R^{14}$ represents an unsubstituted alkylene group having 1 to 16 carbon atoms or a substituted alkylene group having about 10 to about 100 carbon atoms in total per pyrazoloazole ring, e.g., $—S—CH_2CH_2—S—$,

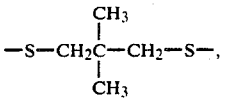

etc); X represents a divalent group appropriately formed from the monovalent groups for X described above.

The linking group represented by $R^{11}$, $R^{12}$, $R^{13}$ or X in the cases wherein the coupler moiety represented by the general formula (IV), (V), (VI), (VII), (VIII), (IX) or (X) is included in a vinyl monomer includes an alkylene group (including an unsubstituted alkylene group having 1 to 16 carbon atoms or a substituted alkylene group having about 10 to about 100 carbon atoms in total per pyrazoloazole ring, e.g., a methylene group, an ethylene group, a 1,10-decylene group, $—CH_2CH_2OCH_2CH_2—$, etc.), a phenylene group (including an unsubstituted phenylene group or a substituted phenylene group having about 6 to about 100 carbon atoms in total per pyrazoloazole ring, e.g., a 1,4-phenylene group, a 1,3-phenylene group,

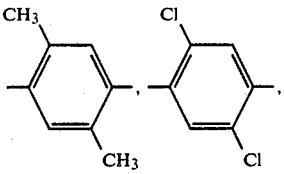

etc.), —NHCO—, —CONH—, —O—, —OCO—, and an aralkylene group having about 8 to about 100 carbon atoms in total per pyrazolazole ring (e.g.,

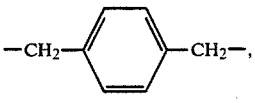

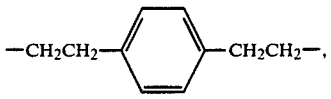

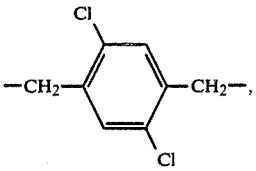

etc.) or a combination thereof.

Specific examples of preferred linking groups are set forth below.

—NHCO—, —$CH_2CH_2$—,

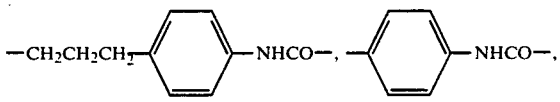

—$CH_2CH_2NHCO$—,

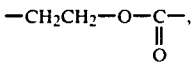

—$CONHCH_2CH_2NHCO$—, —$CONHCH_2CH_2NHCO$—, —$CH_2CH_2OCH_2CH_2$—NHCO—,

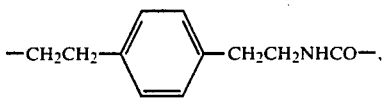

etc.

Further, a vinyl group in the vinyl monomer may further have a substituent in addition to the coupler moiety represented by general formula (IV), (V), (VI), (VII), (VIII), IV) or (X). Preferred examples of the substituents include a hydrogen atom, a chlorine atom or a lower alkyl group having from 1 to 4 carbon atoms (e.g., a methyl group, an ethyl group, etc.).

Among the couplers represented by the general formula (IV), (V), (VI), (VII), (VIII), (IX) or (X), the couplers represented by the general formula (IV), (VII) or (VIII) are preferred for the purpose of the present invention. Further, the couplers represented by the general formula (VIII) are particularly preferred.

A monomer containing the coupler moiety represented by the general formula (IV), (V), (VI), (VII), (VIII), (IX) or (X) may form a copolymer together with a non-color forming ethylenic monomer which does not undergo coupling with the oxidation product of an aromatic primary amine developing agent.

Examples of non-color forming ethylenic monomers which do not undergo coupling with the oxidation product of an aromatic primay amine developing agent include acrylic acid and derivatives thereof such as acrylic acid, α-chloroacrylic acid, α-alkylacrylic acid (e.g., methacrylic acid, etc.), etc., an ester or an amide derived from these acrylic acids (e.g., acrylamide, n-butylacrylamide, tert-butylacrylamide, diacetoneacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate, etc.), methylenedibisacrylamide, a vinyl ester (e.g., vinyl acetate, vinyl propionate, vinyl laurate, etc.), acrylonitrile, methacrylonitrile, an aromatic vinyl compound (e.g, styrene and derivatives thereof, vinyltoluene, divinylbenzene, vinylacetophenone, sulfostyrene, etc.), itaconic acid, citraconic acid, crotonic acid, vinylidene chloride, a vinyl alkyl ether (e.g., vinyl ethyl ether, etc), maleic acid, maleic anhydride, a maleic acid ester, N-vinyl-2-pyrrolidone, N-vinylpyridine, 2- or 4-vinylpyridine, etc.

Two or more non-color forming ethylenically unsaturated monomers can be used together. For example, a combination of n-butyl acrylate and methyl acrylate, styrene and methacrylic acid, methacrylic acid and acrylamide, methyl acrylate and diacetoneacrylamide, etc., can be used.

As is well known in the field of polymer color couplers, the non-color forming ethylenically unsaturated monomer which is copolymerized with a solid water-insoluble monomer coupler can be selected in such a manner that the copolymer formed has good physical properties and/or chemical properties, for example, solubility, compatibility with a binder in a photographic colloid composition, such as gelatin, flexibility, heat stability, etc.

The polymer couplers used in the present invention may be water-soluble coupler or water-insoluble couplers, but polymer coupler latexes are particularly preferred as such polymer couplers.

Specific examples of the pyrazoloazole type magenta couplers represented by the general formula (I) which can be used in the present invention and methods for preparation thereof are described, for example, in Japanese Patent Application (OPI) Nos. 162548/84, 171956/84, 43659/85, 172982/85 and 33552/85 and U.S. Pat. No. 3,061,432, etc.

Specific examples of representative magenta couplers and vinyl monomers for preparing polymer couplers according to the present invention are set forth below, but the present invention should not be construed as being limited thereto.

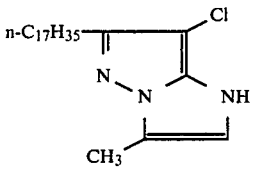

(M-1)

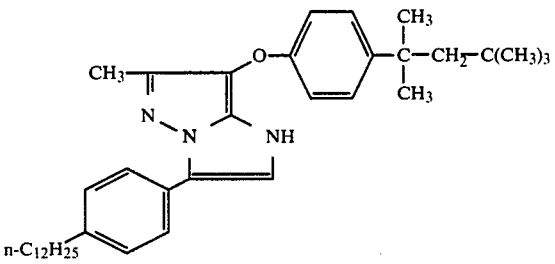

(M-2)

-continued
(M-3)
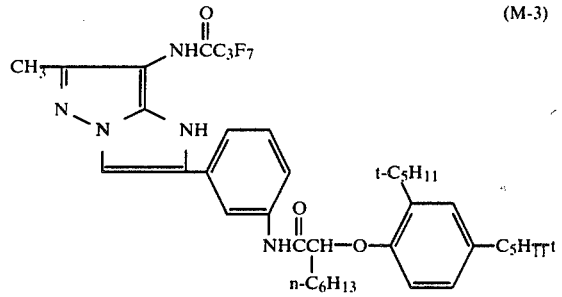
(M-4)
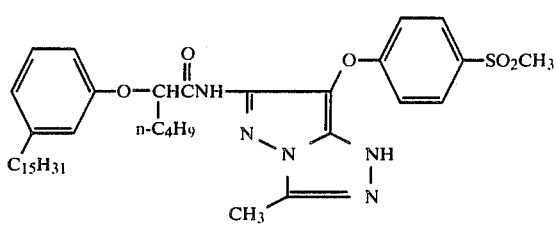
(M-5)
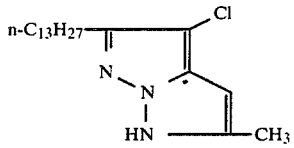
(M-6)
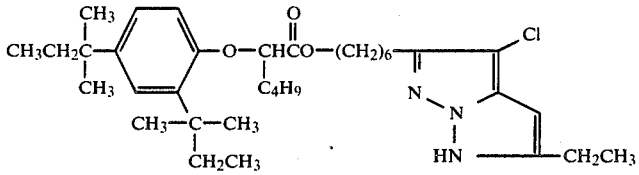
(M-7)
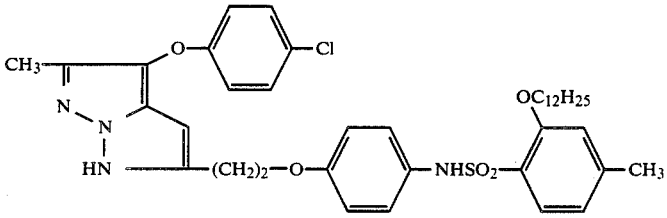
(M-8)
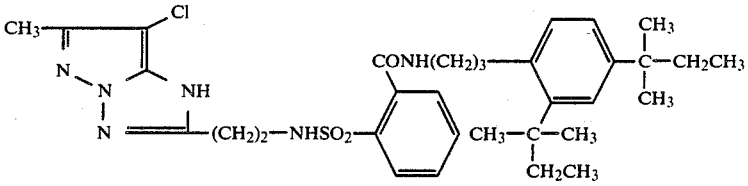
(M-9)
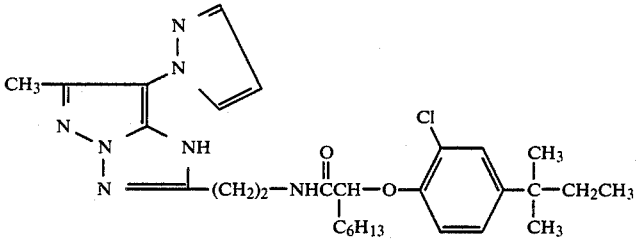
(M-10)
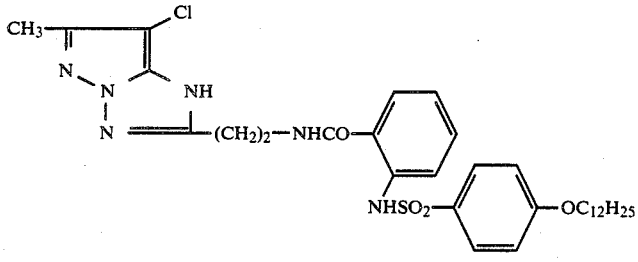

-continued
(M-11)
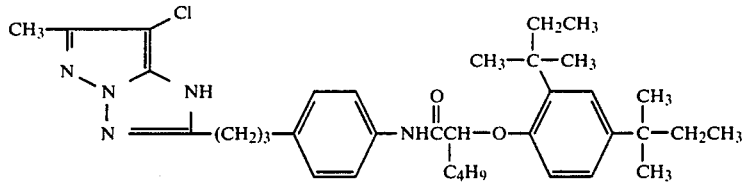
(M-12)
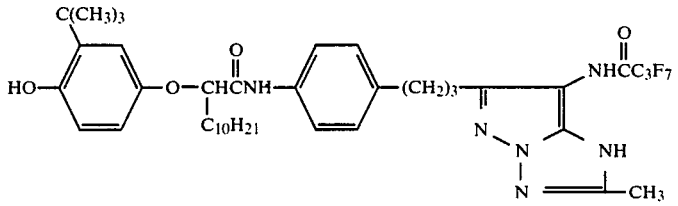
(M-13)
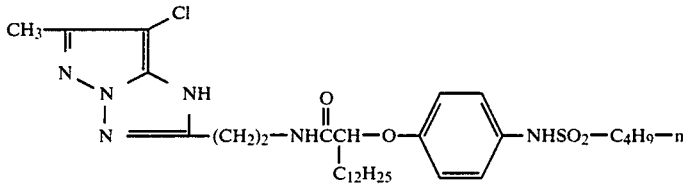
(M-14)
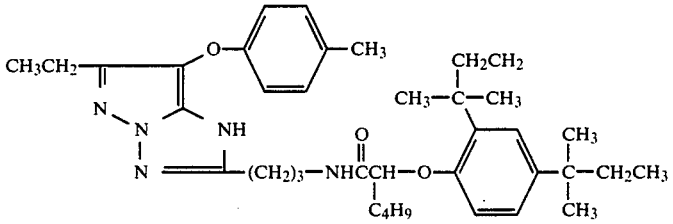
(M-15)
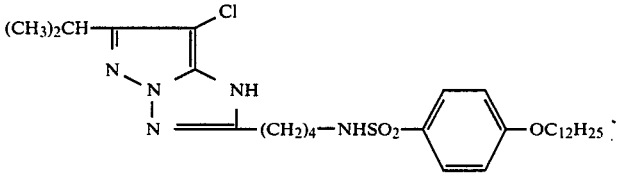
(M-16)
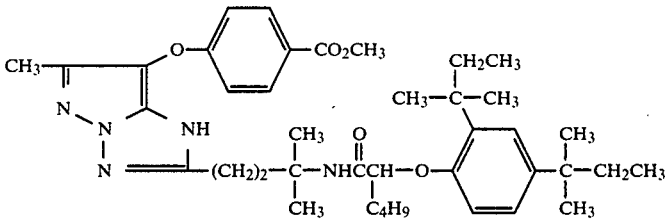
(M-17)
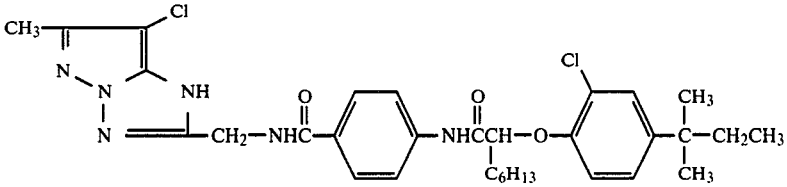

-continued
(M-18)
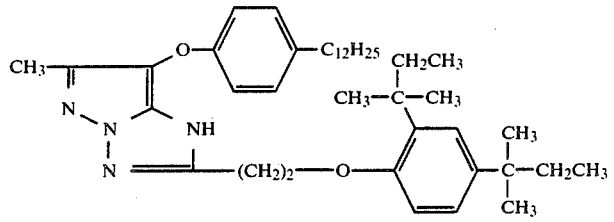
(M-19)
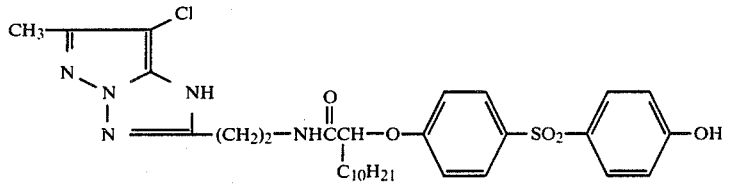
(M-20)
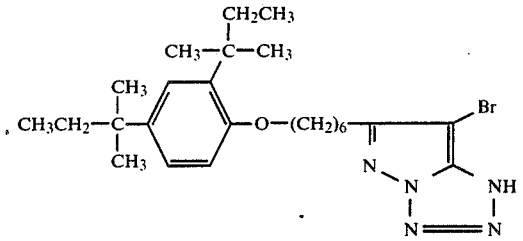
(M-21)
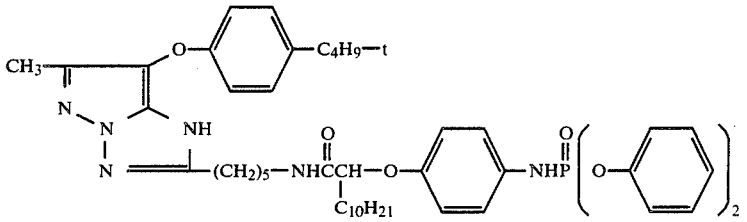
(M-22)
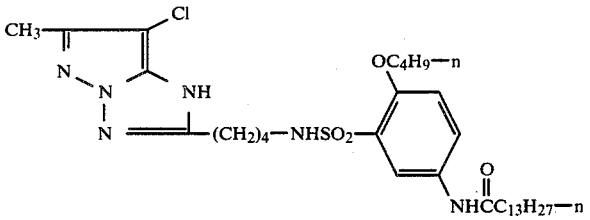
(M-23)
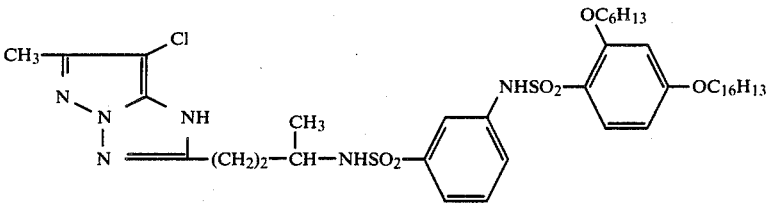
(M-24)
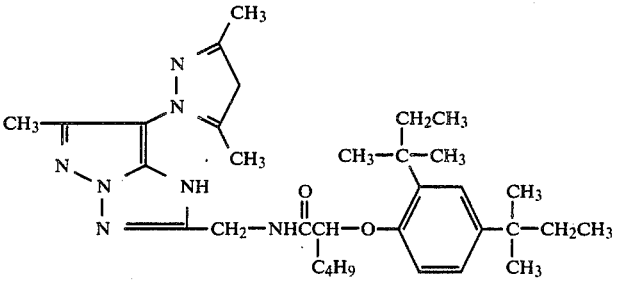

-continued
(M-25)
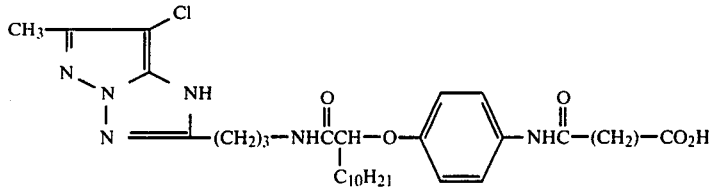
(M-26)
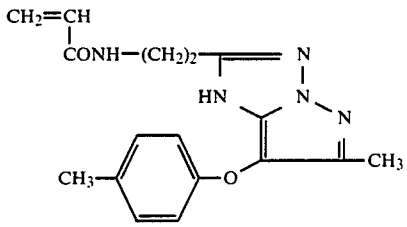
(M-27)
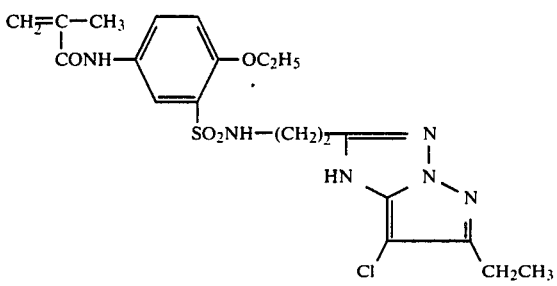
(M-28)
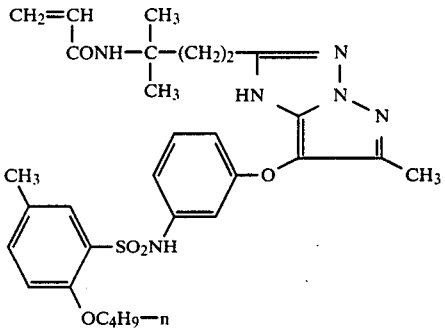
(M-29)
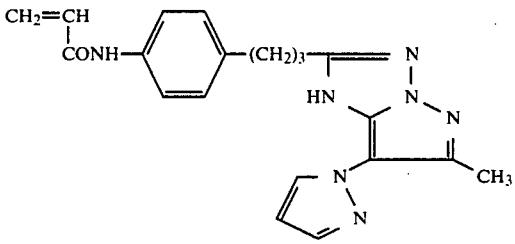
(M-30)
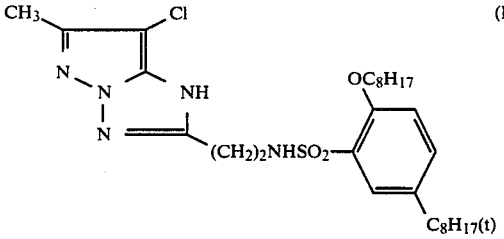
(M-31)
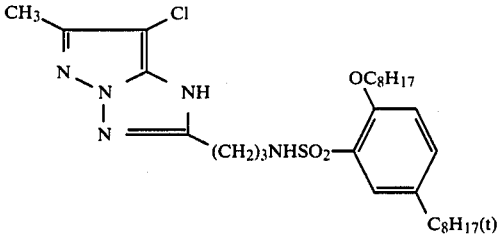
(M-32)
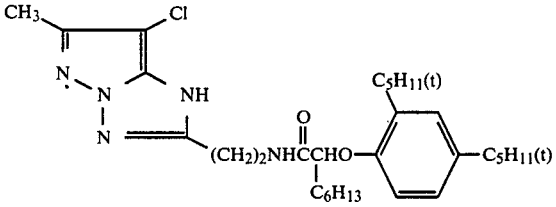
(M-33)
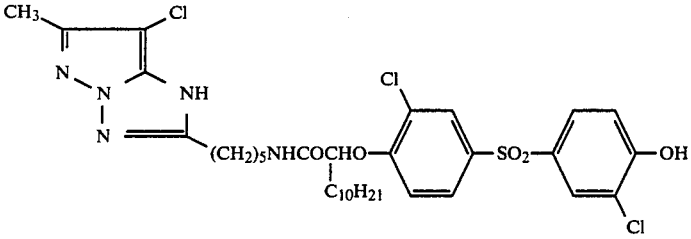

-continued
(M-34)
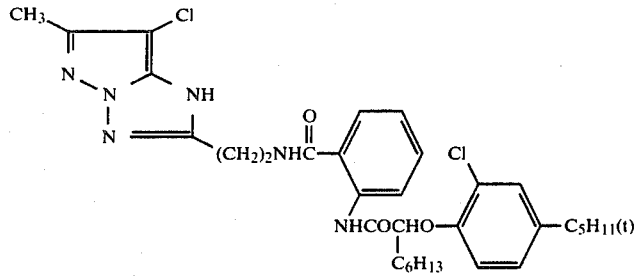
(M-35)
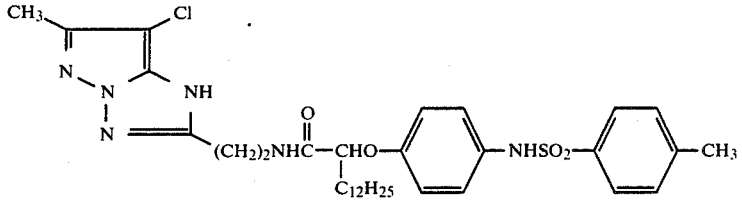
(M-36)
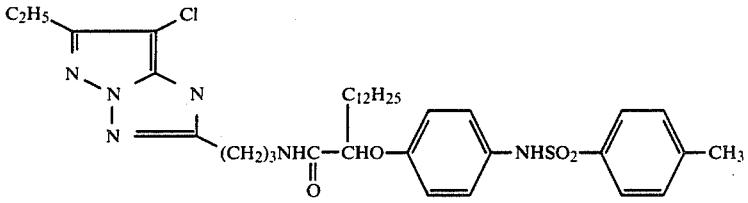
(M-37)
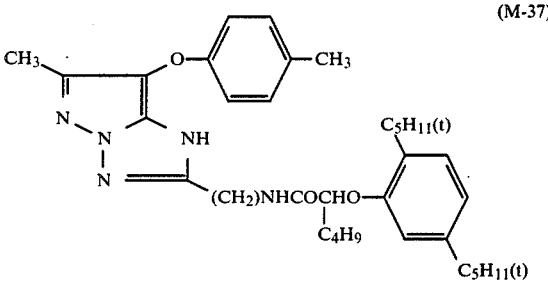
(M-38)
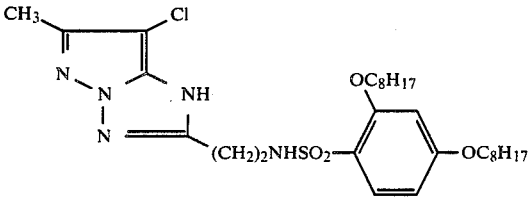
(M-39)
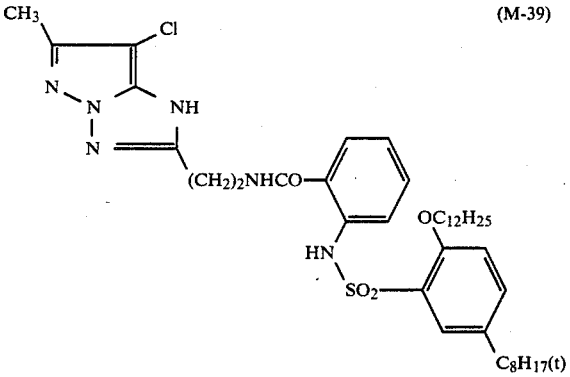
(M-40)
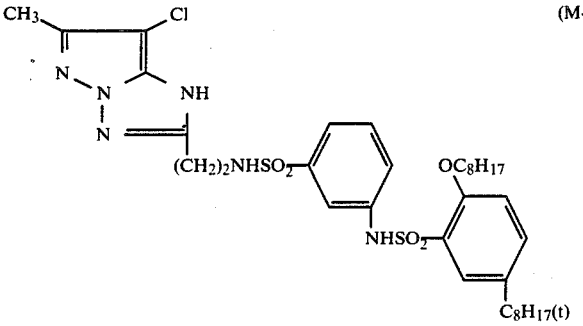
(M-41)
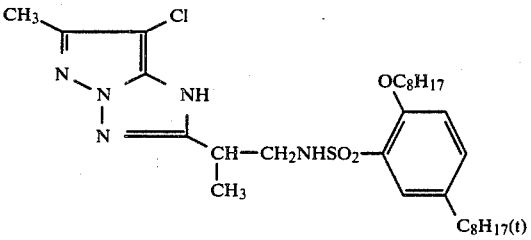

-continued
(M-42)
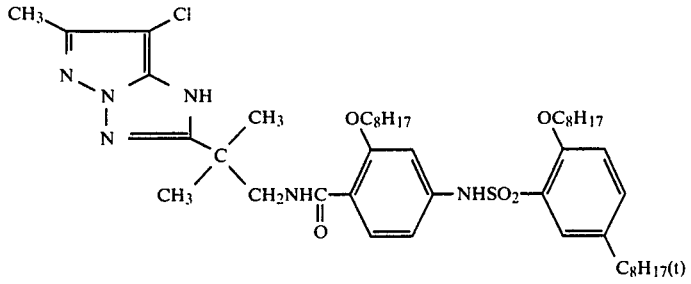
(M-43)
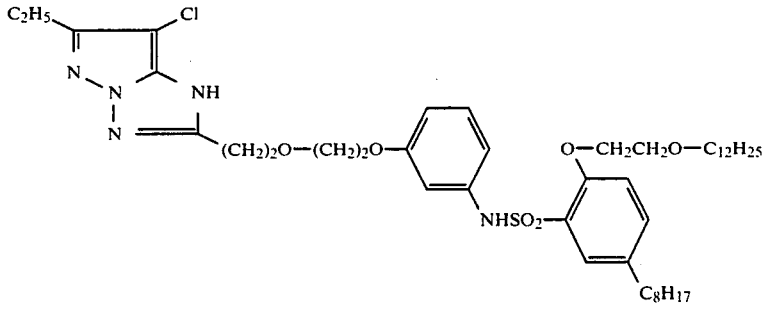
(M-44)
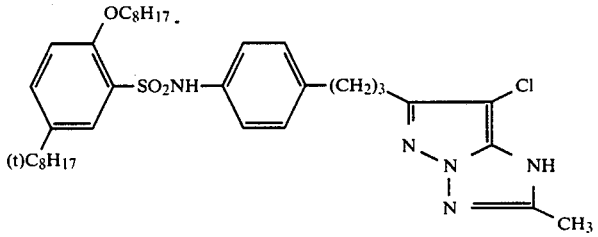
(M-45)
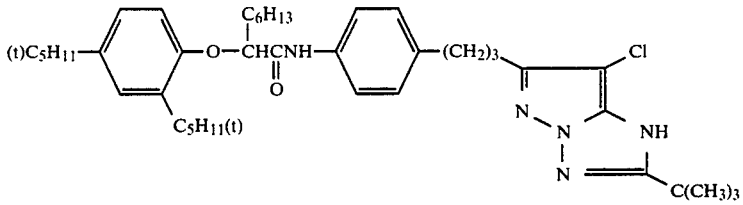
(M-46)
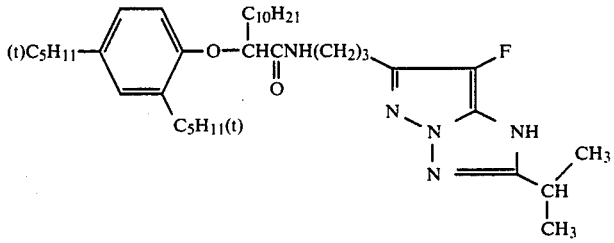
(M-47)
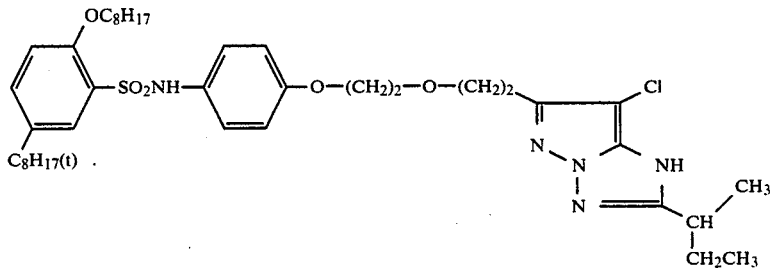

-continued
(M-48)
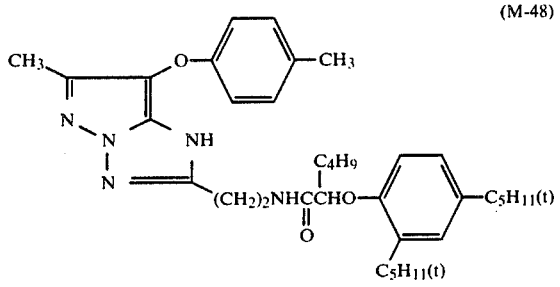
(M-49)
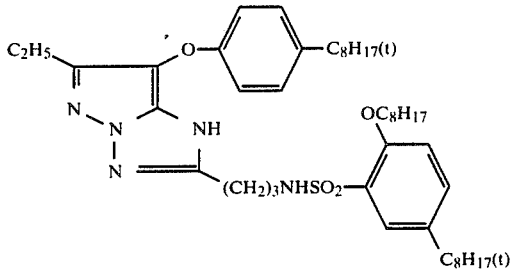
(M-50)
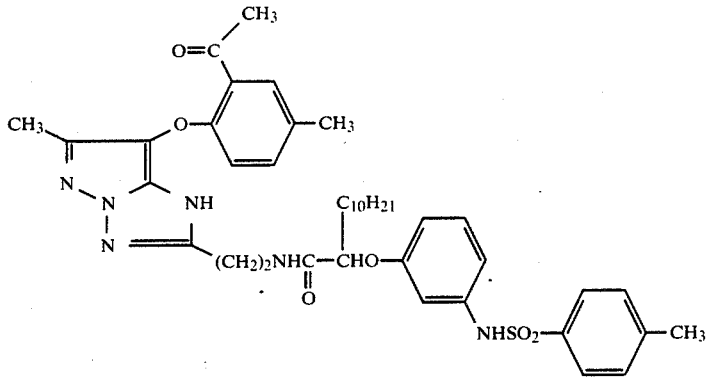
(M-51)
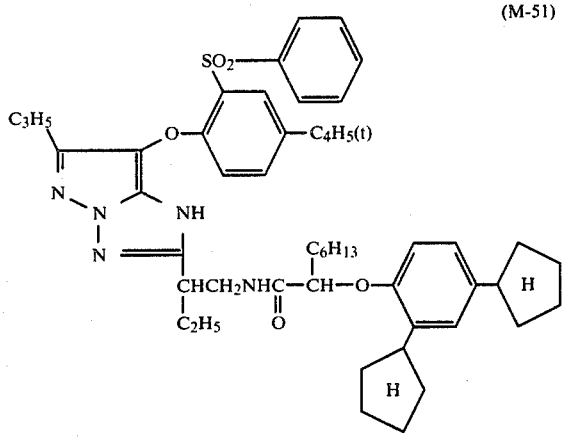
(M-52)
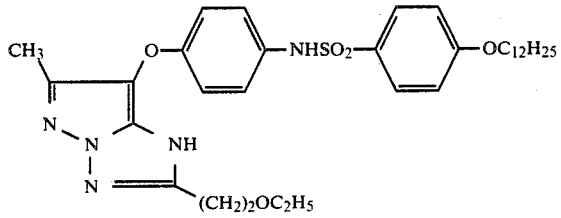
(M-53)
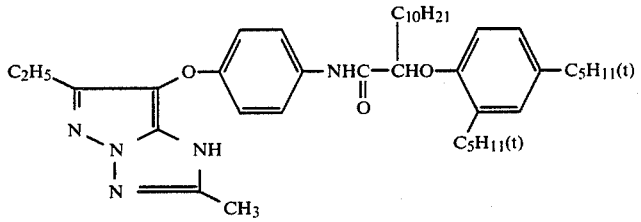
(M-54)
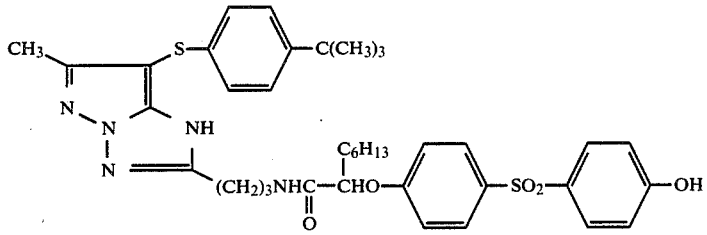

-continued
(M-55)
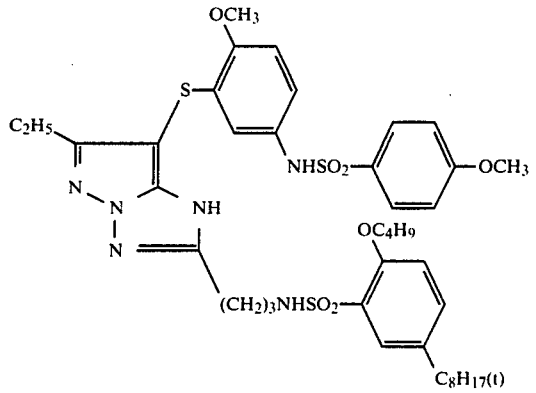
(M-56)
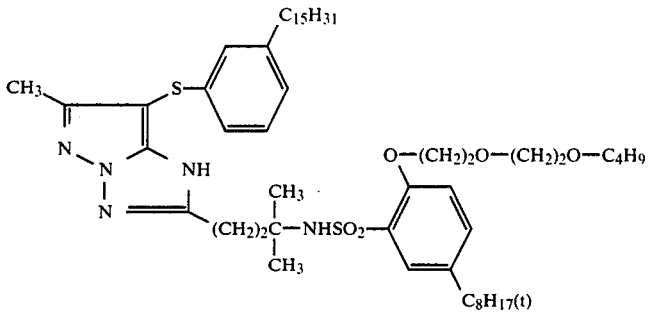
(M-57)
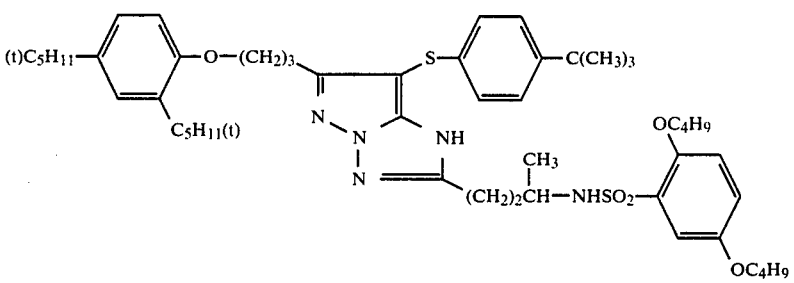
(M-58)
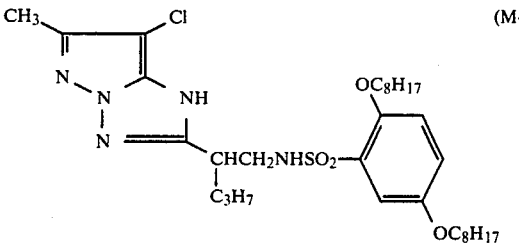
(M-59)
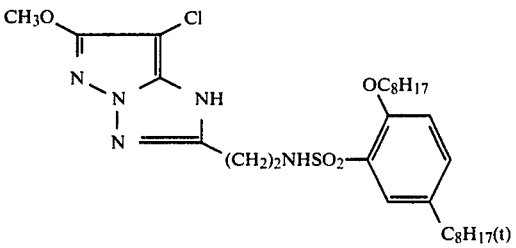
(M-60)
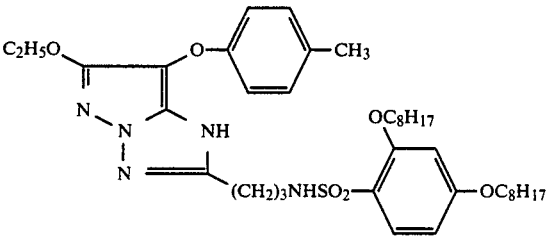

-continued
(M-61)
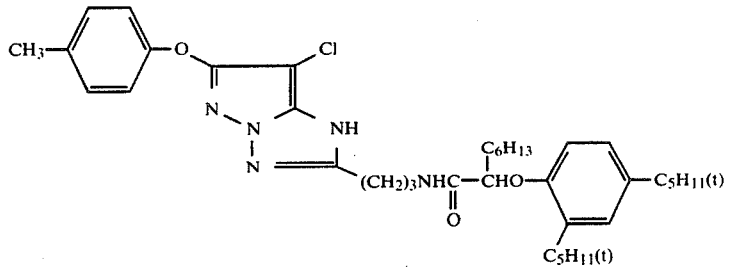
(M-62)
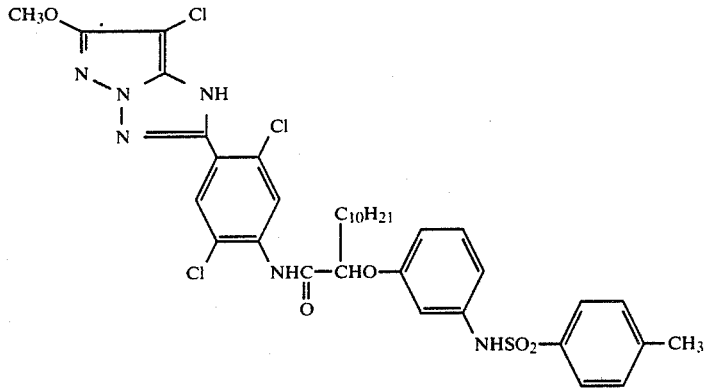
(M-63)
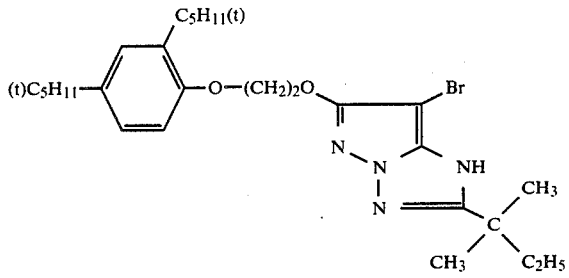
(M-64)
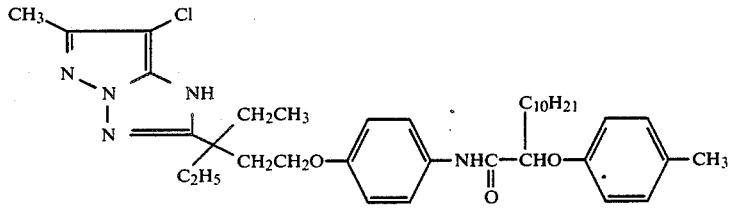
(M-65)
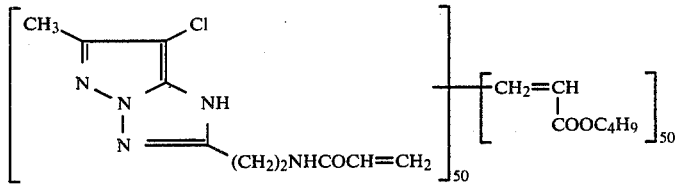
(M-66)
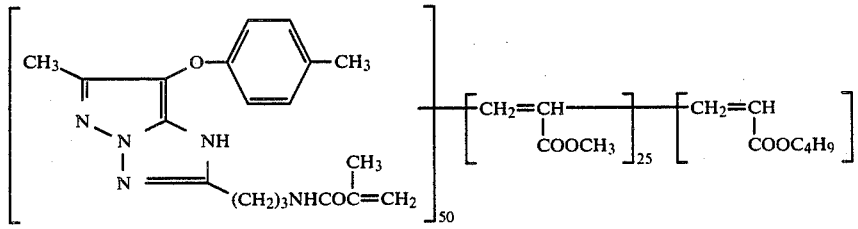

-continued
(M-67)
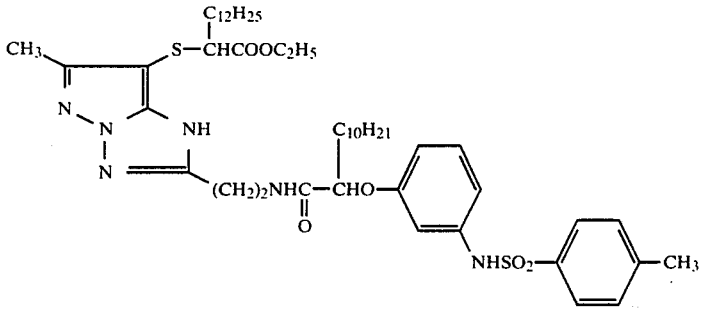
(M-68)
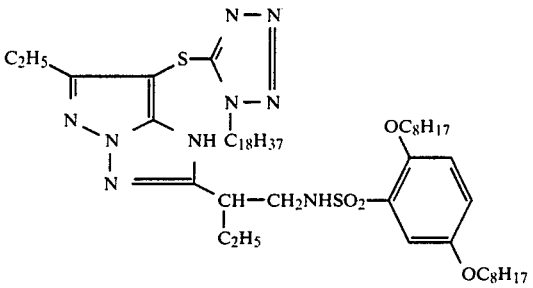
(M-69)
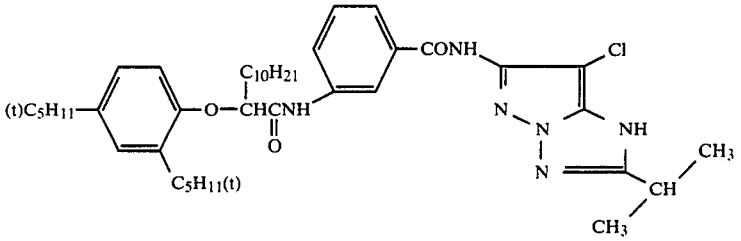
(M-70)
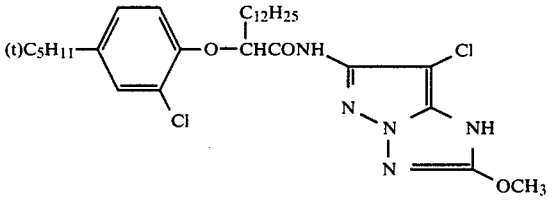
(M-71)
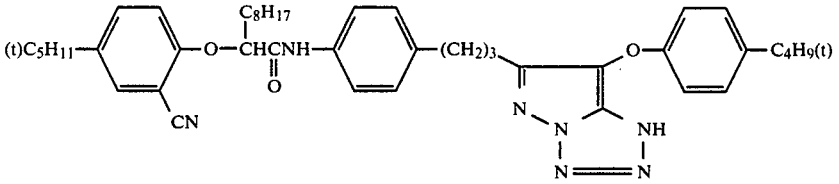
(M-72)
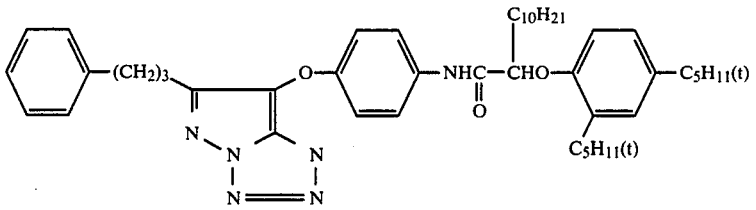

-continued
(M-73)
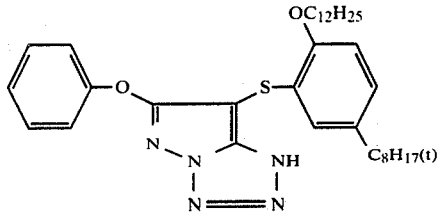
(M-74)
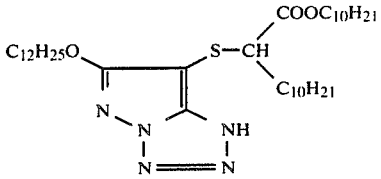
(M-75)
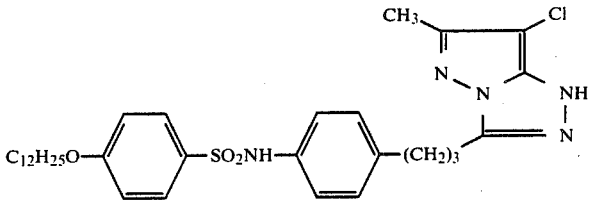
(M-76)
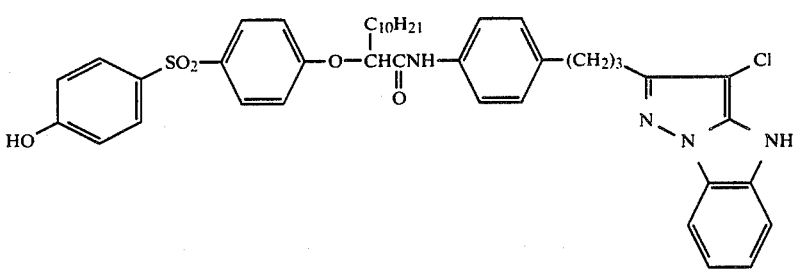
(M-77)
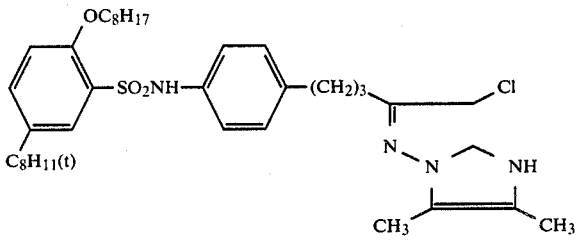
(M-78)
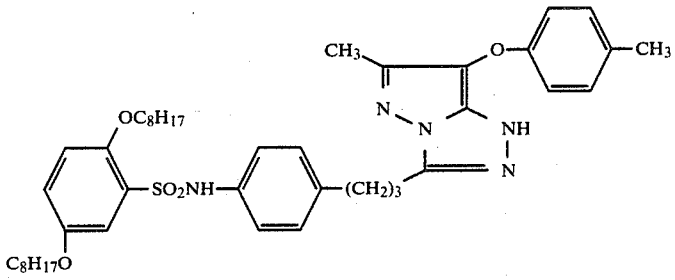
(M-79)
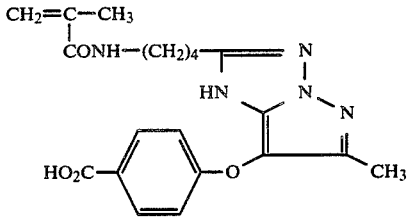
(M-80)
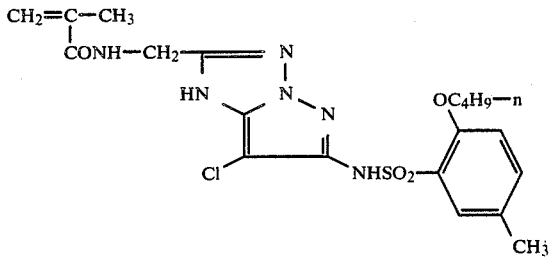

-continued

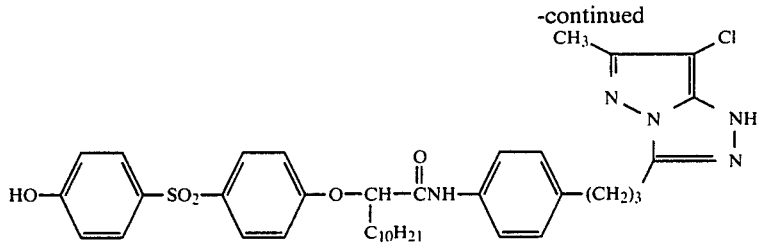

(M-81)

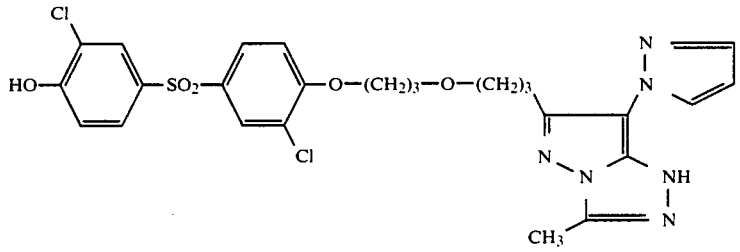

(M-82)

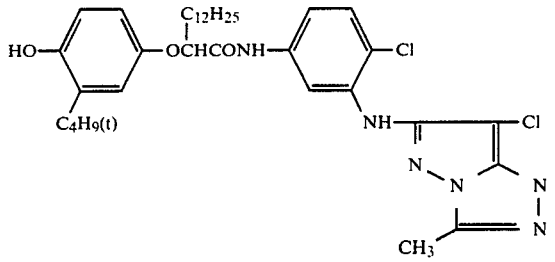

(M-83)

The coupler represented by the general formula (I) according to the present invention is incorporated into the silver halide emulsion layer in an amount of from $1\times10^{-3}$ to 1 mol, and preferably from $5\times10^{-2}$ to $5\times10^{-1}$ mol, per mol of silver halide present in the layer. Further, two or more kinds of the couplers according to the present invention may be incorporated into the same emulsion layer.

The compounds represented by the general formula (II) or (III) are described in detail below.

In the general formula (II) or (III), $R^2$, $R^3$, $R^4$ and $R^5$, which may be the same or different, each represents a hydrogen atom; a hydroxy group; an aliphatic residue [for example, an alkyl group (e.g., a methyl group, an ethyl group, a propyl group, a pentyl group, a hexyl group, an octyl group, an isopropyl group, a sec-butyl group, a tert-butyl group, a cyclohexyl group, a cyclopentylmethyl group, a 2-norbornyl group, etc.), etc.] an alkyl group substituted with an aromatic group (e.g., a benzyl group, a phenethyl group, a benzhydryl group, a 1-naphthylmethyl group, a 3-phenylbutyl group, etc.); an alkyl group substituted with an alkoxy group (e.g., a methoxymethyl group, a 2-methoxyethyl group, a 3-ethoxypropyl group, a 4-methoxybutyl group, etc.); an alkyl group substituted with a hydroxy group, a carboxy group or an alkoxycarbonyl group (e.g., a hydroxymethyl group, a 2-hydroxyethyl group, a 3-hydroxybutyl group, a carboxymethyl group, a 2-carboxyethyl group, a 2-(methoxycarbonyl)ethyl group, etc.); or an aromatic residue [for example, an aryl group (e.g., a phenyl group, a 1-naphthyl group, etc.); an aryl group having a substituent (e.g., a p-tolyl group, an m-ethylphenyl group, an m-cumenyl group, a mesityl group, a 2,3-xylyl group, a p-chlorophenyl group, an o-bromophenyl group, a p-hydroxyphenyl group, a 1-hydroxy-2-naphthyl group, an m-methoxyphenyl group, a p-ethoxyphenyl group, a p-carboxyphenyl group, an o-(methoxycarbonyl)phenyl group, an m-(ethoxycarbonyl)phenyl group, a 4-carboxy-1-naphthyl group, etc.), etc.].

Further, $R^2$ and $R^3$ may be bonded each other to form a 5-membered or 6-membered saturated or unsaturated ring (e.g., cyclopentane, cyclohexane, bensene, etc.)

The compound represented by the general formulae (II) or (III) according to the present invention can be incorporated into the light-sensitive emulsion layer containing the magenta coupler represented by the general formula (I) according to the present invention, any of other light-sensitive layers such as a red-sensitive layer and a blue-sensitive layer or light-insensitive layers such as interlayers and protective layers or all of them.

The amount of the compound represented by the general formulae (II) or (III) effective for the purpose of the present invention is at least $5.0\times10^{-4}$ mol per mol of silver halide contained in the photographic light-sensitive material. However, when the compound is incorporated in an amount of $1.0\times10^{-1}$ mol per mol of silver halide or more, secondary effects in that the sensitivity is decreased and in that desired color density is difficult to obtain etc., may be sometime accompanied. Usually, therefore, the compound is preferably used in a range from $1.0\times10^{-3}$ to $2.0\times10^{-2}$ mol per mol of silver halide.

To add the compound represented by the general formula (II) or (III) according to the present invention to a processing solution (for example, a developing solution and/or a bleach-fixing solution) in an amount as described above is also effective for the purpose of the present invention. However, it is more preferred that the compound is incorporated into the photographic light sensitive material.

Of the compounds represented by the general formula (II) or (III), hydroxytetraazaindene compounds are preferred.

Specific examples of preferred compounds represented by the general formula (II) or (III) according to the present invention are set forth below, but the present invention should not be construed as being limited thereto.

(A-1)

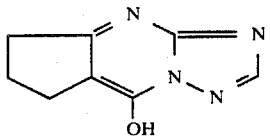

(A-2)

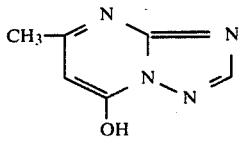

(A-3)

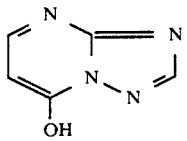

(A-4)

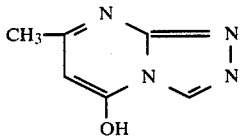

(A-5)

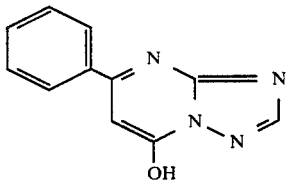

(A-6)

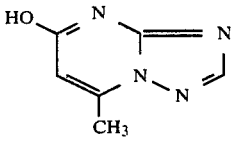

(A-7)

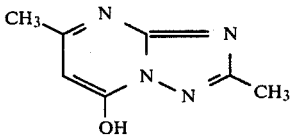

(A-8)

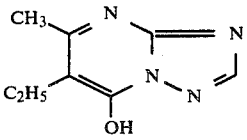

(A-9)

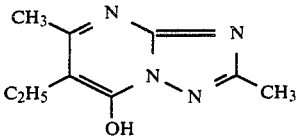

-continued (A-10)

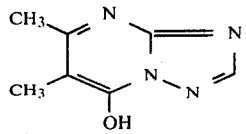

(A-11)

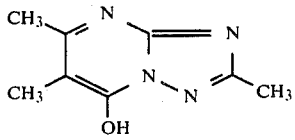

(A-12)

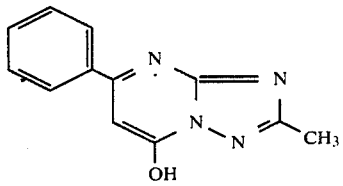

(A-13)

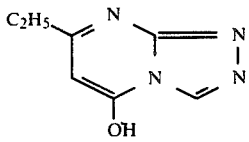

(A-14)

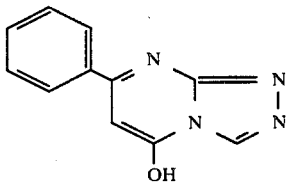

(A-15)

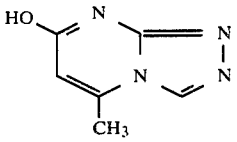

Various additives which are employed at the time of preparing silver halide emulsions according to the present invention are described below.

During the formation of silver halide particles in the present invention, a silver halide solvent can be used in order to control growth of the particles. Suitable examples of silver halide solvents include ammonia, potassium thiocyanate, ammonium thiocyanate, a thioether compound (for example, those described in U.S. Pat. Nos. 3,271,157, 3,574,628, 3,704,130, 4,297,439 and 4,276,374, etc.), a thione compound (for example, those described in Japanese Patent Application (OPI) Nos. 144319/78, 82408/78 and 77737/80, etc.), an amine compound (for example, those described in Japanese Patent Application (OPI) No. 100717/79, etc.), and the like.

The formation or physical ripening of silver halide particles may be carried out in the presence of cadmium salts, zinc salts, thallium salts, iridium salts or complex salts thereof, rhodium salts or complex salts thereof, iron salts or complex salts thereof, and the like.

Silver halide emulsions are usually chemically sensitized. For the chemical sensitization, for example, the methods as described in H. Frieser ed., *Die Grundlagen der photographischen Prozesse mit Silberhalogeniden,*

Akademische Verlags gesellschaft, pages 675 to 734 (1968) can be used. That is, a sulfur sensitization method using active gelatin or compounds containing sulfur capable of reacting with silver (for example, thiosulfates, thioureas, mercapto compounds and rhodanines, etc.), a reduction sensitization method using reducing substances (for example, stannous salts, amines hydrazine derivatives, formamidinesulfinic acid and silane compounds, etc.) a noble metal sensitization method using noble metal compounds (for example, complex salts of Group VIII metals in the Periodic Table, such as Pt, Ir and Pd, etc., as well as gold complex salts); and so forth can be applied alone or in combination with each other.

The photographic emulsions of the present invention may include various compounds for the purpose of preventing fog formation or of stabilizing photographic properties of photographic light-sensitive materials during the production, storage or photographic processing thereof. For example, those compounds known as antifoggants or stabilizers can be incorporated, including azoles, such as benzothiazolium salts, nitroindazoles, triazoles, benzotriazoles, benzimidazoles (particularly nitro-substituted or halogen-substituted benzimidazoles), etc.: heterocyclic mercapto compounds, such as mercaptothiazoles, mercaptobenzothiazoles, mercaptobenzimidazoles, mercaptopobenzimidazoles, mercaptothiadiazoles, mercaptotetrazoles (particularly 1-phenyl-5-mercaptotetrazole), mercaptopyrimidines, etc.; those heterocyclic mercapto compounds having a water-soluble group such as a carboxy group or a sulfo group; thioketo compounds, such as oxazolinethione, etc.; benzenethiosulfonic acids; benzenesulfinic acids; etc.

The silver halide photographic emulsions used in the present invention may contain cyan couplers or yellow couplers capable of forming color upon oxidative coupling with aromatic primary amine developing agents (e.g., phenylenediamine derivatives, aminophenol derivatives, etc.). Examples of such couplers include yellow couplers, such as acylacetamide couplers (e.g., benzoylacetanilides, pivaloylacetanilides, etc.), etc.; and cyan couplers, such as naphthol couplers and phenol couplers, etc. It is preferable to use non-diffusible couplers containing a hydrophobic group (so-called ballast group) within the molecule. They may be either 4-equivalent or 2-equivalent with respect to silver ions. The pyrazoloazole magenta couplers represented by the general formula (I) described above may be employed in combination with other magenta couplers, such as 5-pyrazolone couplers, cyanoacetylcoumarone couplers and open chain acylacetonitrile couplers, etc.

Further, the photographic emulsions used in the present invention may contain colored couplers capable of exerting color correction effects, or couplers capable of releasing development inhibitors during the course of development (so-called DIR couplers).

Moreover, the photographic emulsions may contain non-color-forming DIR coupling compounds which release a development inhibitor, the product of which formed by a coupling reaction is colorless.

The photographic emulsions used in the present invention may contain compounds such as polyalkylene oxides or their ether, ester, amine or like derivatives, thioether compounds, thiomorpholines, quaternary ammonium salt compounds, urethane derivatives, urea derivatives, imidazole derivatives, and 3-pyrazolidones, etc., for the purpose of increasing sensitivity or contrast, or of accelerating development.

The silver halide photographic emulsions used in the present invention may contain known water-soluble dyes as filter dyes or for various purposes, for example, irradiation prevention. Examples of such dyes include oxonol dyes, hemioxonol dyes and merocyanine dyes, etc.

Further, known cyanine dyes, merocyanine dyes and hemicyanine dyes, etc., may be incorporated into the photographic emulsions before, during or after chemical sensitization thereof, as spectral sensitizing dyes or for other purposes, for example, control of the crystal form or the particle size of silver halide, etc.

The photographic emulsions used in the present invention may contain various surface active agents as coating aids or for other various purposes, e.g., prevention of charging, improvement of slipping properties, acceleration of emulsification and dispersion, prevention of adhesion, improvement of photographic characteristics (particularly development acceleration, high contrast, and sensitization), etc.

Moreover, into the photographic light-sensitive material according to the present invention can be incorporated color fading preventing agents, hardening agents, ultraviolet ray absorbing agents, etc. Specific examples of protective colloids such as gelatin, etc., and the various additives described above are described, for example, in *Research Disclosure,* Vol. 176, No. 17643 (December, 1978), etc.

The finished emulsions can be coated on appropriate supports, for example, baryta coated paper, resin coated paper, synthetic paper, tracetatefilms, polyethylene terephthalate films, other plastic bases, glass plates, etc.

The processing temperature is usually selected from a range of 18° C. to 50° C., although it may be lower than 18° C. or higher than 50° C.

Bleaching agents which can be used in the bleach-fixing bath include compounds of polyvalent metals, e.g., iron (III), cobalt (III), chromium (VI), copper (II), etc. Preferred examples include organic complex salts of iron (III) or cobalt (III), for example, complex salts of organic acids, such as aminopolycarboxylic acids (e.g., ethylenediaminetetraacetic acid, diethylenetriamine pentaacetic acid, nitrilotriacetic acid, 1,3-diamino-2-propanoltetraacetic acid, etc.) or organic acids (e.g., citric acid, tartaric acid, malic acid, etc.). Of these compounds, iron (III) salt of ethylenediamine tetraacetic acid is particularly preferred in view of rapid processing and prevention of environmental pollution.

In the bleach-fixing solution, various kinds of accelerators may be employed, if desired. For example, bromide ions, iodide ions, thiourea type compounds as described in U.S. Pat. No. 3,706,561, Japanese Patent Publications Nos. 8506/70 and 26586/74, Japanese Patent Application (OPI) Nos. 32735/78,, 36233/78 and 37016/78, etc., thiourea type compounds as described in Japanese Patent Application (OPI) Nos. 124424/78, 95631/78, 57831/78, 32736/78, 65732/78 and 52534/79, U.S. Pat. No. 3,893,858, etc., heterocyclic compounds as described in Japanese Patent Application (OPI) Nos. 59644/74, 140129/75, 28426/78, 141623/78, 104232/78 and 35727/79, etc., thioether type compounds as described in Japanese Patent Application (OPI) Nos. 20832/77, 25064/80 and 26506/80, etc., tertiary amines as described in Japanese Patent Application (OPI) No. 84440/73, etc., thiocarbamoyls as described in Japanese Patent Application (OPI) No. 42349/74, etc., and the like may be employed individually or in combinations of two or more thereof.

Of these compounds, bromide ions, iodide ions, thiol type compounds or disulfide type compounds are preferred bleach accelerators. They are particularly effective in case of bleach-fixing color photographic light-sensitive materials for photography.

Examples of fixing agents include thiosulfates, thiocyanates, thioether type compounds, thioureas, a large amount of iodides, etc. Of these compounds, thiosulfates are generally employed. As preservatives for the bleach-fixing solution, sulfites, bisulfites and carbonyl bisulfite adducts are preferably employed.

After the bleach-fixing processing, water washing processing is usually carried out. In the water washing step, various known compounds may be employed for the purpose of preventing precipitation, saving water, etc. For example, a water softener such as an inorganic phosphoric acid, an aminopolycarboxylic acid or an organic phosphoric acid, a sterilizer or antimold agent for preventing the propagation of various bacteria, algae and molds, a hardening agent such as a magnesium salt or an aluminium salt, a surface active agent for reducing drying load or preventing drying marks, or the like may be added, if desired. Further, the compounds described in L. E. West. "Water Quality Criteria" in *Photo. Sci. and Eng.*, Vol. 6, pages 344 to 359 (1965) may be added. Particularly, the addition of chelating agents and antimold agents is effective.

The water washing step is ordinarily carried out using countercurrent processing with two or more tanks in order to save water. Further, in place of the water washing step as described in Japanese Patent Application (OPI) No. 8543/82 may be conducted.

It is particularly preferred to apply the present invention to processing of color print materials such as color papers and color reversal papers.

The present invention is explained in greater detail with reference to the following examples, but the present invention should not be construed as being limited thereto.

In the following Examples all units, percentages, ratios, etc., are by weight, unless otherwise noted.

EXAMPLE 1

On a paper support, both surfaces of which were laminated with polyethylene, were coated layers as shown Table 1 below in order to prepare a multilayer color photographic light-sensitive material for a printing paper. The coating solutions were prepared in the following manner.

Preparation of Coating Solution for First Layer:

10 g of Yellow Coupler (a) and 2.1 g of Color Image Stabilizer (b) were dissolved in a mixture of 10 ml of ethyl acetate and 1.4 ml of Solvent (c) and the resulting solution was dispersed in 90 ml of a 10% aqueous solution of gelatin containing 10 ml of a 1% aqueous solution of sodium dodecylbenzenesulfonate. Separately, to a silver chlorobromide emulsion (having a bromide content of 85 mol% and containing 70 g of silver per Kg of the emulsion) was added $2.25\times10^{-4}$ mols of a blue-sensitive dye shown below per mole of the silver chlorobromide to prepare a blue-sensitive emulsion. The above described dispersion was mixed with 95 g of the blue-sensitive silver chlorobromide emulsion, with the concentration of the resulting mixture being controlled with gelatin, to form the composition shown in Table 1 below, i.e., the coating solution for the first layer.

Coating solutions for the second layer to the seventh layer were prepared so that the compositions described in Table 1 were obtained. 2,4-Dichloro-6-hydroxy-s-triazine sodium salt was used as a gelatin hardener in each layer.

The following spectral sensitizing dyes were employed in the emulsion layers, respectively.

Blue-Sensitive Emulsion Layer:

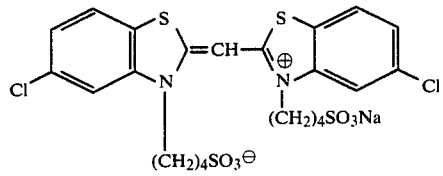

Green-Sensitive Emulsion Layer:

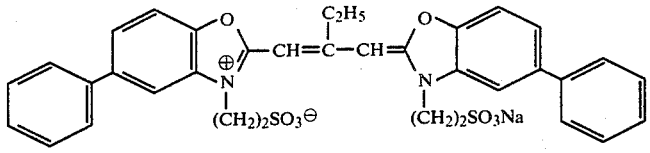

Red-Sensitive Emulsion Layer:

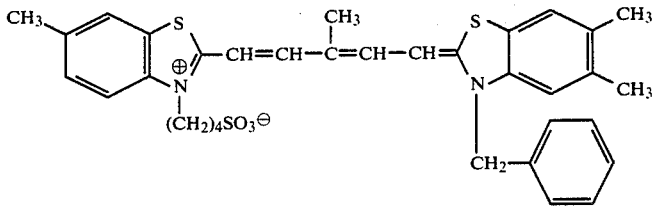

The following dyes were employed as irradiation preventing dyes in the emulsion layers, respectively.

Green-Sensitive Emulsion Layer:

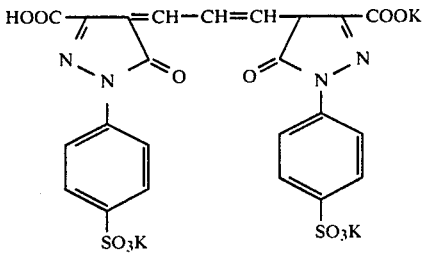

Red-Sensitive Emulsion Layer:

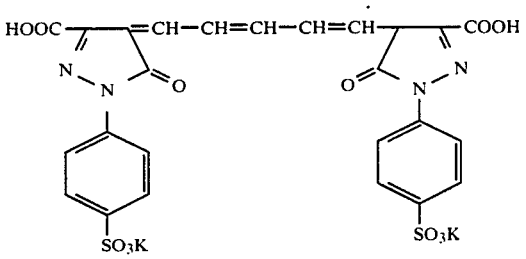

TABLE 1

| Layer | Main Composition | Amount Used |
|---|---|---|
| Seventh Layer (Protective layer) | Gelatin | 1.33 g/m$^2$ |
| Sixth Layer (Ultraviolet light absorbing layer) | Gelatin | 0.62 g/m$^2$ |
| | Ultraviolet Light Absorbing Agent (f) | $5.10\times10^{-4}$ mol/m$^2$ |
| | Solvent (c) | 0.07 g/m$^2$ |
| Fifth Layer | Silver Chlorobromide Emulsion (silver bromide: 50 mol %) | 0.22 g/m$^2$ (as silver) |
| | Gelatin | 0.93 g/m$^2$ |
| | Cyan Coupler (g) | $7.05\times10^{-4}$ mol/m$^2$ |
| | Color Image Stabilizer (h) | $5.20\times10^{-4}$ mol/m$^2$ |
| | Solvent (i) | 0.25 g/m$^2$ |
| Fourth Layer (Ultraviolet light absorbing layer) | Gelatin | 1.43 g/m$^2$ |
| | Ultraviolet Light Absorbing Agent (f) | $1.50\times10^{-3}$ mol/m$^2$ |

TABLE 1-continued

| Layer | Main Composition | Amount Used |
|---|---|---|
| | Color Mixing Preventing Agent (d) | $1.50\times10^{-4}$ mol/m$^2$ |
| | Solvent (c) | 0.22 g/m$^2$ |
| Third Layer (Green-sensitive layer) | Silver Chlorobromide Emulsion (silver bromide: 70 mol %) | Shown in Table 2 |
| | Gelatin | " |
| | Magenta Coupler | " |
| | Color Image Stabilizer | " |
| | Solvent | |
| Second Layer (Intermediate layer) | Gelatin | 0.92 g/m$^2$ |
| | Color Mixing Preventing Agent (d) | $2.33\times10^{-4}$ mol/m$^2$ |
| | Solvent (e) | 0.15 g/m$^2$ |
| First Layer (Blue-sensitive layer) | Silver Chlorobromide Emulsion (silver bromide: 85 mol %) | 0.38 g/m$^2$ |
| | Gelatin | 1.41 g/m$^2$ |
| | Yellow Coupler (a) | $7.22\times10^{-4}$ mol/m$^2$ |
| | Color Image Stabilizer (b) | $1.35\times10^{-4}$ mol/m$^2$ |
| | Solvent (c) | 0.08 g/m$^2$ |
| Support | Polyethylene laminated paper (the polyethylene coating containing a white pigment ($TiO_2$, etc.) and a bluish dye (ultramarine, etc.) on the first layer side). | |

The compounds used in the above layers have the structures shown below respectively.

Yellow Coupler (a):

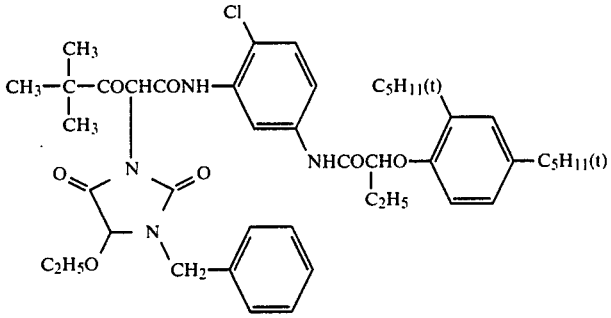

Color Image Stabilizer (b):

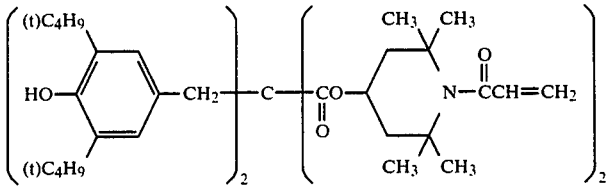

Solvent (c):

$(C_9H_{19}O)_3P=O$

Color Mixing Preventing Agent (d):

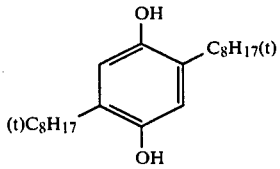

Solvent (e):
A mixture of

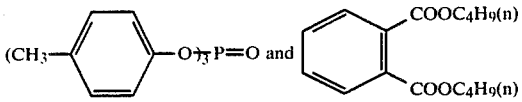

in a ratio of 1:1 by volume.

Ultraviolet Light Absorbing Agent (f):
A mixture of

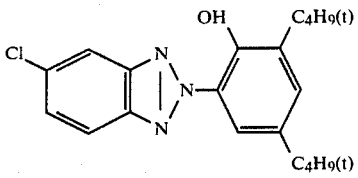

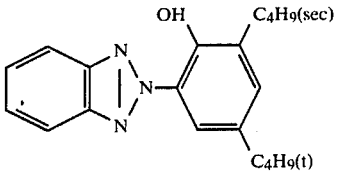

and

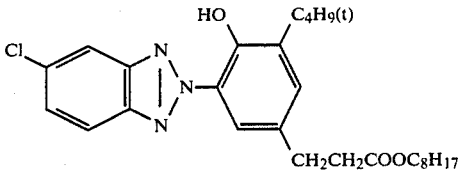

in a ratio of 1:5:3 by mole.

Cyan Coupler (g):
A mixture of

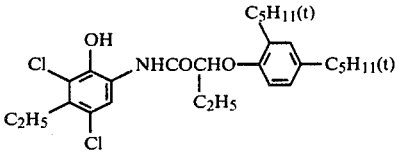

and in a ratio of 1:1 by mole.

Color Image Stabilizer (h):
A mixture of

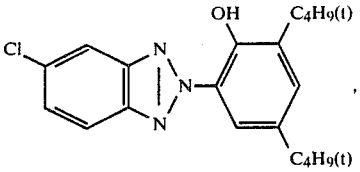

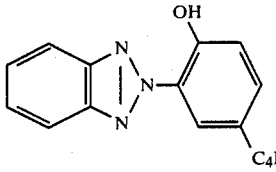

and

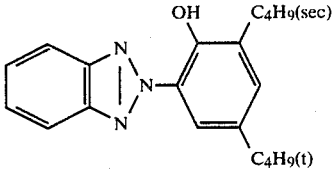

in a ratio of 1:3:3 by mole.

Solvent (i):
A mixture of

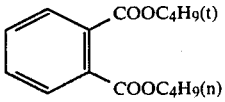

and $(C_9H_{19}O)_3P{=}O$ in a ratio of 1:2 by volume.

The balance of surface tension and viscosity was adjusted for the coating solutions of the first layer to the seventh layer and then they were coated simultaneously on the support to prepare a multilayer silver halide color photographic light-sensitive material.

Samples A to H were prepared with third layers having different compositions. The coating compositions of the third layers of Samples A to H are shown Table 2 below. Compound A-1 according to the present invention was added to the coating composition as a 1% aqueous solution.

TABLE 2

| | Composition of Third Layer (Green-Sensitive Layer) | | | | | | | |
|---|---|---|---|---|---|---|---|---|
| | A | B | C | D | E | F | G | H |
| Silver ($g/m^2$) | 0.21 | — | — | — | 0.25 | — | 0.19 | — |
| Gelatin ($g/m^2$) | 1.30 | — | — | — | — | — | — | — |
| Magenta Coupler | M-11 | — | — | — | M-41 | — | M-81 | — |
| Amount of Coupler ($mol/m^2$) | $4.20 \times 10^{-4}$ | — | — | — | — | — | — | — |
| Color Image Stabilizer (j) ($mol/m^2$) | $2.10 \times 10^{-4}$ | — | — | — | — | — | — | — |
| Solvent (k) ($g/m^2$) | 0.25 | — | — | — | — | — | — | — |
| Compound A-1 ($g/m^2$) | 0 | 0.01 | 0.05 | 0.1 | 0 | 0.01 | 0 | 0.01 |
| Remark | Comparison | Present invention | Present invention | Present invention | Comparison | Present invention | Comparison | Present invention |

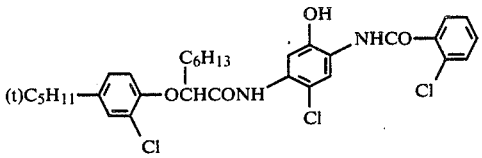

Color Image Stabilizer (j):

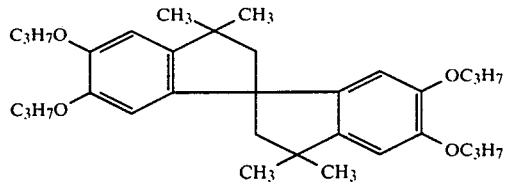

Solvent (k)

$(C_8H_{17}O)_3P=O$

These silver halide color photographic light-sensitive material were subjected to uniform exposure so as to provide the maximum densities of yellow, magenta and cyan and then development processing according to the following processing steps using the following processing solutions was carried out.

Once the samples were processed, the amount of silver in the photographic material was determined by a fluorescence X-ray analysis method. The results thus obtained are shown in Table 3 below.

| | Temperature (°C.) | |
|---|---|---|
| Color Development | 33 | 3 min 30 sec |
| Bleach-Fixing | 33 | 30 sec, 60 sec, 90 sec |
| Washing with water | 33 | 3 min |

The composition of each processing solution was as follows.

| Color Developing Solution | |
|---|---|
| Water | 800 ml |
| Sodium tetrapolyphosphate | 2.0 g |
| Benzyl alcohol | 14.0 ml |
| Diethylene glycol | 10.0 ml |
| Sodium sulfite | 2.0 g |
| Potassium bromide | 0.5 g |
| Sodium carbonate | 30.0 g |

-continued

| Color Developing Solution | |
|---|---|
| N—Ethyl-N—(β-methanesulfonamidoethyl)-3-methyl-4-aminoaniline sulfonate | 5.0 g |
| Hydroxylamine sulfate | 4.0 g |
| Water to make | 1,000 ml |
| pH (at 25° C.) | 10.20 |

| Bleach-Fixing Solution A | |
|---|---|
| Water | 400 ml |
| Ammonium thiosulfate (70% soln.) | 150 ml |
| Sodium sulfate | 18 g |
| Ammonium ethylenediamine-tetraacetate iron (III) | 55 g |
| Disodium ethylenediaminetetraacetate | 5 g |
| Water to make | 1000 ml |
| pH (at 25° C.) | 7.00 |

Bleach-Fixing Solution B 300 ml of the color developing solution was added to Bleach-Fixing Solution A.

Bleach-Fixing Solution C

An exhausted solution continuously processed using a Fuji Color Rall Processor FMRP-115 (manufactured by Fuji Photo Film Co., Ltd).

TABLE 3

| | Amount of Remaining Silver (g/m²) | | | | | | | | | |
|---|---|---|---|---|---|---|---|---|---|---|
| | Bleach-Fixing Solution A | | | Bleach-Fixing Solution B | | | Bleach-Fixing Solution C | | | |
| Sample | 30" | 60" | 90" | 30" | 60" | 90" | 30" | 60" | 90" | Remark |
| A | 0.58 | 0.39 | 0.06 | 0.68 | 0.45 | 0.12 | 0.73 | 0.52 | 0.18 | Comparison |
| B | 0.53 | 0.35 | 0.04 | 0.58 | 0.37 | 0.03 | 0.59 | 0.38 | 0.04 | Present Invention |
| C | 0.50 | 0.31 | 0.03 | 0.51 | 0.33 | 0.04 | 0.54 | 0.35 | 0.03 | " |
| D | 0.50 | 0.29 | 0.03 | 0.50 | 0.31 | 0.04 | 0.51 | 0.33 | 0.03 | " |
| E | 0.59 | 0.41 | 0.06 | 0.62 | 0.45 | 0.16 | 0.64 | 0.48 | 0.19 | Comparison |
| F | 0.53 | 0.34 | 0.03 | 0.54 | 0.34 | 0.03 | 0.52 | 0.35 | 0.02 | Present Invention |
| G | 0.54 | 0.33 | 0.06 | 0.56 | 0.36 | 0.11 | 0.58 | 0.39 | 0.16 | Comparison |
| H | 0.50 | 0.30 | 0.02 | 0.50 | 0.29 | 0.02 | 0.52 | 0.30 | 0.03 | Present Invention |

It is apparent from the results shown in Table 3 that insufficient silver removal caused by processing with a bleach-fixing solution of reduced bleach-fixing power is effectively prevented by the addition of the compound represented by the general formula (II) according to the present invention.

EXAMPLE 2

Samples I to T were prepared in the same manner as described in Example 1 except that a 2% aqueous solution of Compound A-2 according to the present invention was added to the layers as shown in Table 4 and the samples contained compounds, etc., equivalent to those used in Example 1 as shown in Table 4.

TABLE 4

| Sample | | I | J | K | L | M | N | O | P | Q | R | S | T |
|---|---|---|---|---|---|---|---|---|---|---|---|---|---|
| Seventh Layer | A-2 (g/m²) | 0 | 0 | 0 | 0 | 0 | 0 | 0 | 0 | 0 | 0 | 0 | 0.002 |
| Sixth Layer | A-2 (g/m²) | 0 | 0 | 0 | 0 | 0 | 0 | 0 | 0 | 0 | 0 | 0 | 0.001 |
| Fifth Layer | A-2 (g/m²) | 0 | 0 | 0 | 0 | 0 | 0 | 0 | 0 | 0.005 | 0.002 | 0 | 0.001 |
| Fourth Layer | A-2 (g/m²) | 0 | 0 | 0.03 | 0 | 0 | 0 | 0 | 0 | 0 | 0 | 0.008 | 0.001 |
| | A-2 (g/m²) | 0 | 0.03 | 0 | 0 | 0.02 | 0 | 0.02 | 0.01 | 0.005 | 0.002 | 0.001 | 0.002 |
| Third Layer | Silver Amount in Green-Sensitive Emulsion (g/m²) | 0.45 | 0.03 | 0 | 0.02 | 0.02 | 0.21 | 0.02 | 0.01 | 0.005 | 0.002 | 0.001 | 0.002 |
| | Magenta Coupler | (I) | 0.03 | 0 | (m) | 0.02 | M-19 | 0.02 | 0.01 | 0.005 | 0.002 | 0.001 | 0.002 |
| Second Layer | A-2 (g/m²) | 0 | 0 | 0 | 0 | 0 | 0 | 0 | 0 | 0 | 0.001 | 0 | 0.001 |
| First Layer | A-2 (g/m²) | 0 | 0 | 0 | 0 | 0 | 0 | 0 | 0.01 | 0.01 | 0.005 | 0.003 | 0.002 |
| | | Comparison | 0 | 0 | 0 | 0 | 0 | Present | 0.01 | 0.01 | 0.005 | 0.003 | 0.002 |

TABLE 4-continued

| Sample | I | J | K | L | M | N | O | P | Q | R | S | T |
|---|---|---|---|---|---|---|---|---|---|---|---|---|
| | | | | | | | invention | | | | | |

Magenta Coupler (l):

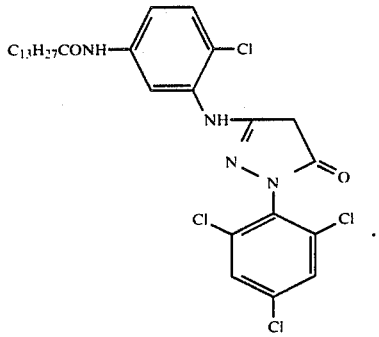

Magenta Coupler (m):

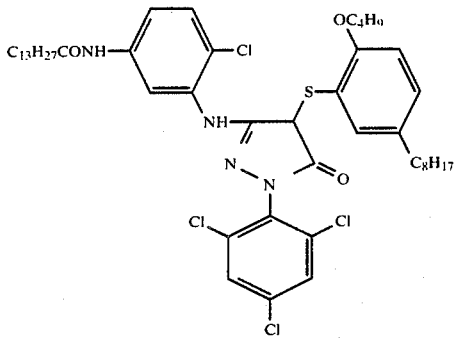

Samples I to T were exposed to light in the same manner as described in Example 1 and then subjected to continuous processing according to the processing steps shown below using a Fuji Color Roll Processor FPR-115 (manufactures by Fuji Photo Film Co., Ltd.)

| Processing Step | Time | Temperature | Capacity of Tank |
|---|---|---|---|
| Color Development | 3 min 30 sec | 38° C. ± 0.3° C. | 60 l |
| Bleach-Fixing | 1 min 30 sec | 33° C. ± 1° C. | 40 l |
| Washing with water (1) | 1 min | 33° C. ± 3° C. | 20 l |
| Washing with water (2) | 1 min | 33° C. ± 3° C. | 20 l |
| Washing with Water (3) | 1 min | 33° C. ± 3° C. | 20 l |

The washing with water steps were carried out by a three-step countercurrent water washing process from washing with water (3) to washing with water (1).

Further, the amount of processing solution carried over into each tank from the preceding tank was 60 ml per $m^2$ of the photographic light-sensitive material processed in each step from the bleach-fixing step to the washing with water step (3).

The condition of the color development step was the same in all cases, and the amount of replenisher was 161 ml per $m^2$ of the photographic light-sensitive material processed. The composition of the color developing solution used was as follows.

| Color Developing Solution | Tank Solution | Replenisher |
|---|---|---|
| Water | 800 ml | 800 ml |
| Trisodium nitrilotriacetate | 2.0 g | 2.0 g |
| Benzyl alcohol | 14 ml | 18 ml |

-continued

| Color Developing Solution | Tank Solution | Replenisher |
|---|---|---|
| Diethylene glycol | 10 ml | 10 ml |
| Sodium sulfite | 2.0 g | 2.5 g |
| Hydroxylamine sulfate | 3.0 g | 3.5 g |
| Potassium bromide | 1.0 g | — |
| Sodium carbonate | 30 g | 35 g |
| N—Ethyl-N—(β-methanesulfonamido-ethyl)-3-methyl-4-aminoaniline sulfate | 5.0 g | 8.0 g |
| Water to make | 1000 ml (pH 10.15) | 1000 ml (pH 10.65) |

The condition of the bleach-fixing step was the same in all cases, and the amount of replenisher was 60 ml per $m^2$ of the photographic light-sensitive material processed. The composition of the bleach-fixing solution used was as follows.

| | | |
|---|---|---|
| Water | 400 ml | 400 ml |
| Ammonium thiosulfate (70% soln.) | 150 ml | 300 ml |
| Sodium sulfite | 18 g | 36 g |
| Ammonium ethylenediaminetetra-acetate iron (III) | 55 g | 110 g |
| Disodium ethylenediaminetetra-acetate | 5 g | 10 g |
| Water to make | 1000 ml (pH 6.70) | 1000 ml (pH 6.50) |

The conditions of the washing with water steps were the same in all cases, and the amount of replenisher was 250 ml per $m^2$ of the photographic light-sensitive material processed. The composition of the water washing solution used was as follows.

| Water Washing Solution: | |
|---|---|
| 1-Hydroxyethylidene-1,1-diphosphonic acid (60% aqueous solution) | 2.0 ml |
| Aluminium sulfate | 1.0 g |
| Sulfanilamide | 0.1 g |
| Water to make | 1 liter |
| adjusted pH to 7.0 with aqueous ammonia | |

After processing 50 $m^2$ of each sample and after processing 2,000 $m^2$ of each sample, the amount of silver remaining in the photographic material was determined. The results obtained are shown in Table 5.

TABLE 5

| Sample | Amount of Remaining Silver ($g/m^2$) 50 $m^2$ | 2,000 $m^2$ | Magenta Coupler | |
|---|---|---|---|---|
| I | 0.03 | 0.04 | 5-Pyrazolone Coupler | Comparison |
| J | 0.03 | 0.04 | " | " |
| K | 0.03 | 0.03 | " | " |
| L | 0.02 | 0.03 | " | " |
| M | 0.02 | 0.03 | " | " |
| N | 0.06 | 0.18 | Pyrazoloazole Coupler | " |
| O | 0.04 | 0.04 | | Present invention |
| P | 0.04 | 0.04 | " | Present invention |
| Q | 0.04 | 0.04 | " | Present invention |
| R | 0.04 | 0.04 | " | Present invention |
| S | 0.03 | 0.03 | " | Present invention |
| T | 0.04 | 0.04 | " | Present invention |

The amounts of the color developing agents contained in the bleach-fixing solution after processing 50 $m^2$ and 2,000 $m^2$ of the photographic light-sensitive material were $3.1\times10^{-5}$ mol and $5.3\times10^{-4}$ mol per mol of the bleaching agent, respectively.

It is apparent from the results shown in Table 5 that the so-called insufficient silver removal occurred when an exhausted developer solution was used with a magenta coupler represented by the general formula (I) of the present invention and that such a disadvantage is effectively removed by use of a compound represented by the general formula (II) of the present invention.

EXAMPLE 3

Samples C, F, H. J. M and O were subjected to the same development processing as shown in Example 2 without exposure to light. The samples thus processed were stored in a fluorescent lamp fading tester of 20,000 lux for 30 days, in darkness at 80° C. (dry) for 30 days and in darkness at 60° C. and 70% RH for 40 days and, thereafter, the degree of yellow stain in the white background areas was determined. The amounts of yellow densities increased in the white background areas are shown in Table 6.

TABLE 6

| Sample | Fluorescent Lamp | 80° C. | 60° C. & 70% RH | Magenta Coupler | Remark |
|---|---|---|---|---|---|
| C | 0.04 | 0.06 | 0.09 | Pyrazoloazole coupler | Present invention |
| F | 0.05 | 0.05 | 0.08 | Pyrazoloazole coupler | Present invention |
| H | 0.05 | 0.08 | 0.07 | Pyrazoloazole coupler | Present invention |
| J | 0.21 | 0.29 | 0.24 | 5-Pyrazolone coupler | Comparison |
| M | 0.12 | 0.11 | 0.09 | 5-Pyrazolone coupler | Comparison |
| O | 0.06 | 0.07 | 0.07 | Pyrazoloazole coupler | Present invention |

It is understood from the results shown in Table 6 that the pyrazoloazole magenta couplers represented by the general formula (I) according to the present invention are excellent in view of the degree of yellow stain in the white background areas under various storage conditions in comparison with conventional 5-pyrazolone magenta couplers.

While the invention has been described in detail and with reference to specific embodiments thereof, it will be apparent to one skilled in the art that various changes and modifications can be made therein without departing from the spirit and scope thereof.

What is claimed is:

1. A method for forming an image in a silver halide color photographic light-sensitive material comprising developing an imagewise exposed silver halide color photographic light-sensitive material and then bleach fixing the silver halide color photographic light-sensitive material in a bleach fixing bath, the silver halide photographic color light sensitive material comprising a support having thereon a silver halide emulsion layer containing a yellow coupler, a silver halide emulsion layer containing a magenta coupler and a silver halide emulsion layer containing a cyan coupler, wherein the silver halide emulsion layer containing the magenta coupler contains at least one pyrazoloazole type coupler represented by the general formula (I):

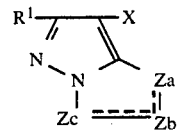

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, —N= or —NH—, one of the Za-Zb bond and the Zb-Zc bond being a double bond and the other being a single bond; an aromatic ring may be condensed to the Zb-Zc bond; $R^1$ or X may form a polymer including a dimer or more; and when Za, Zb or Zc is a substituted methine group, the substituted methine group may form a polymer including a dimer or more; a photographic layer of the silver halide color photographic light-sensitive material or a processing solution contains at least $5.0\times10^{-4}$ mol per mol of silver halide contained in the silver halide color photographic light-sensitive material of at least one compound represented by the formulae (II) or (III):

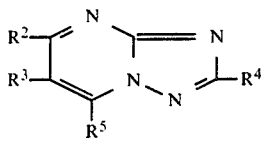

(II)

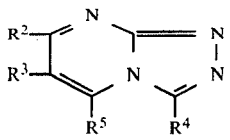

(III)

wherein $R^2$, $R^3$, $R^4$ and $R^5$, which may be the same or different, each represents a hydrogen atom, a hydroxy group, an aliphatic residue, an alkyl group substituted with an aromatic group, an alkyl group substituted with an alkoxy group, an alkyl group substituted with a hydroxy group, a carboxy group or an alkoxy carbonyl group or an aromatic residue; or $R^2$ and $R^3$ may be bonded each other to form a 5-membered or 6-membered saturate or unsaturated ring; and a developing agent which is introduced into the bleach-fixing bath is at least $1.0\times10^{-4}$ mol per mol of a bleaching agent thereof.

2. A method for forming an image as claimed in claim 1, wherein the polymer of the pyrazoloazole type coupler is a bis coupler or a polymer coupler.

3. A method for forming an image as claimed in claim 2, wherein the polymer coupler is a homopolymer composed of a monomer having a moiety represented by the general formula (I) or a copolymer composed of a monomer having a moiety represented by the general formula (I) and a non-color forming ethylenic monomer which does not undergo coupling with the oxidation product of an aromatic primary amine developing agent.

4. A method for forming an image as claimed in claim 1, wherein the pyrazoloazole type coupler is represented by the following general formula (IV), (V), (VI), (VII), (VIII), (IX) or (X):

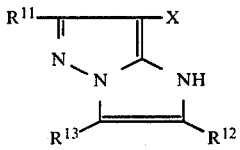

(IV)

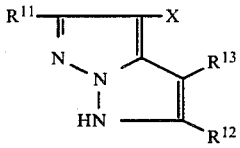

(V)

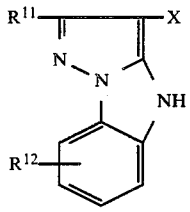

(VI)

-continued

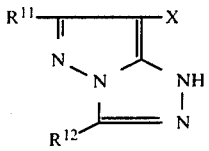

(VII)

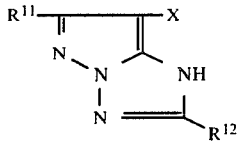

(VIII)

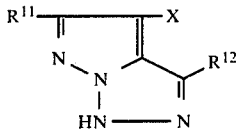

(IX)

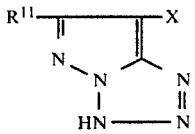

(X)

wherein $R^{11}$, $R^{12}$ and $R^{13}$ each represents a hydrogen atom, a halogen atom, an alkyl group, an aryl goup, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group, or $R^{12}$ and $R^{13}$ in the general formula (IV) or (V) may combine with each other to form a 5-membered, 6-membered or 7-membered ring; X represents a hydrogen atom, a halogen atom, a carboxy group or a group capable of being released upon coupling which is bonded to the carbon atom at the coupling position through an oxygen atom, a nitrogen atom or a sulfur atom; or $R^{11}$, $R^{12}$, $R^{13}$ or X is a divalent group to form a bis coupler.

5. A method for forming an image as claimed in claim 4, wherein the pyrazoloazole type coupler is a polymer coupler in which the coupler moiety derived from the coupler represented by general formula (IV), (V), (VI), (VII), (VIII), (IX) or (X) is present at the main chain or the side chain of the polymer.

6. A method for forming an image as claimed in claim 4, wherein the divalent group to form a bis coupler represented by $R^{11}$, $R^{12}$ or $R^{13}$ is a substituted or unsubstituted alkylene group, a substituted or unsubstituted phenylene group, a group of the formula —NH-CO—$R^{14}$—CONH—, wherein $R^{14}$ represents a substituted or unsubstituted alkylene group or a substituted or unsubstituted phenylene group, or a group of the formula —S—$R^{14}$—S—, wherein $R^{14}$ represents a substituted or unsubstituted alkylene group.

7. A method for forming an image as claimed in claim 4, wherein the divalent group to form a bis coupler represented by X is a divalent group derived from the monovalents group represented by X as defined in claim 4.

8. A method for forming an image as claimed in claim 5, wherein $R^{11}$, $R^{12}$, $R^{13}$ or X in general formula (IV), (V), (VI), (VII), (VIII), (IX) or (X) represents a vinyl group or a linking group to a vinyl group.

9. A method for forming an image as claimed in claim 8, wherein the linking group represented by $R^{11}$, $R^{12}$, $R^{13}$ or X is a substituted or unsubstituted alkylene group, a substituted or unsubstituted phenylene group, —NHCO—, —CONH—, —O—, —OCO—, an alkylene group or a combination thereof.

10. A method for forming an image as claimed in claim 8, wherein the vinyl group may further have a substituent selected from a chlorine atom and a lower alkyl group having from 1 to 4 carbon atoms in addition to the coupler moiety.

11. A method for forming an image as claimed in claim 5, wherein the polymer coupler is a homopolymer.

12. A method for forming an image as claimed in claim 5, wherein the polymer coupler is a copolymer.

13. A method for forming an image as claimed in claim 5, wherein the polymer coupler comprises a copolymer contaiing a repeating unit derived from a non-color forming ethylenic monomer which does not couple with the oxidation product of an aromatic primary amine developing agent.

14. A method for forming an image as claimed in claim 13, wherein the non-color forming monomer is an acrylic acid, an ester of acrylic acid, an amide of acrylic acid, a vinyl ester, an acrylonitrile, an aromatic vinyl compound, itaconic acid, citraconic acid, crotonic acid, vinylidene chloride, a vinyl alkyl ether, maleic acid, maleic anhydride, an ester of maleic acid, N-vinyl-2-pyrrolidone, N-vinyl pyridine or 2: or 4-vinyl pyridine.

15. A method for forming an image as claimed in claim 5, wherein the polymer coupler is in the form of a latex.

16. A method for forming an image as claimed in claim 4, wherein the pyraxoloazole type coupler is represented by the general formula (IV), (VII) or (VIII).

17. A method for forming an image as claimed in claim 5, wherein the polymer coupler is derived from the coupler represented by the general formula (IV), (VII) or (VIII).

18. A method for forming an image as claimed in claim 16, wherein the pyrazoloazole type coupler is represented by the general formula (VIII).

19. A method for forming an image as claimed in claim 17, wherein the polymer coupler is derived from the coupler represented by the general formula (VIII).

20. A method for forming an image as claimed in claim 1, wherein the compound represented by the general formula (II) or (III) is a hydroxytetraazaindene compound.

21. A method for forming an image as claimed in claim 1, wherein an amount of the compound represented by the general formula (II) or (III) is from $1.0\times10^{-3}$ to $2.0\times10^{-2}$ mol per mol of silver halide.

22. A method for forming an image as claimed in claim 1, wherein the compound represented by the general formula (II) or (III) is incorporated into a photographic layer of the silver halide color photographic light-sensitive material.

23. A method for forming an image as claimed in claim 22, wherein the photographic layer is the silver halide emulsion layer containing the pyrazoloazole type coupler represented by the general formula (I).

24. A method for forming an image as claimed in claim 1, wherein the compound represented by the general formula (II) or (III) is added to a processing solution.

25. A method for forming an image as claimed in claim 24, wherein the processing solution is a developing solution and/or a bleach-fixing solution.

26. A method for forming an image as claimed in claim 1, wherein a bleaching agent present in the bleach-fixing bath is an organic complex salt of iron (III) or cobalt (III).

27. A method for forming an image as claimed in claim 26, wherein the bleaching agent is an iron (II) salt of ethylenediaminetetraacetic acid.

28. A method for forming an image as claimed in claim 1, wherein the bleach-fixing bath contains a bleach accelerator.

29. A method for forming an image as claimed in claim 1, wherein a fixing agent present in the bleach-fixing bath is a thiosulfate.

30. A method for forming an image as claimed in claim 1, wherein the silver halide emulsion layer containing the pyrazoloazole type coupler represented by the general formula (I) is a green-sensitive silver halide emulsion layer.

* * * * *